US011891830B2

(12) United States Patent
Goldwitz

(10) Patent No.: US 11,891,830 B2
(45) Date of Patent: Feb. 6, 2024

(54) POP UP CANOPY

(71) Applicant: Brian Goldwitz, Waterbury, CT (US)

(72) Inventor: Brian Goldwitz, Waterbury, CT (US)

( * ) Notice: Subject to any disclaimer, the term of this patent is extended or adjusted under 35 U.S.C. 154(b) by 165 days.

(21) Appl. No.: 17/306,693

(22) Filed: May 3, 2021

(65) Prior Publication Data

US 2022/0349208 A1 Nov. 3, 2022

(51) Int. Cl.
*E04H 15/50* (2006.01)

(52) U.S. Cl.
CPC ..... *E04H 15/50* (2013.01)

(58) Field of Classification Search
CPC ..... E04H 15/50
See application file for complete search history.

(56) References Cited

U.S. PATENT DOCUMENTS 3,152,347 A * 10/1964 Williams ..... E04G 11/54 52/109
3,375,624 A * 4/1968 Mikulin ..... E04C 3/005 52/109
RE31,565 E * 4/1984 Beaulieu ..... E04B 1/3441 211/202
5,274,980 A * 1/1994 Zeigler ..... E04H 15/50 52/646
5,485,863 A * 1/1996 Carter ..... E04H 15/58 135/145
7,131,236 B2 * 11/2006 Sample ..... E04H 1/1277 52/79.5
7,178,539 B2 * 2/2007 Patel ..... E04H 15/50 135/159
7,409,963 B2 * 8/2008 Mallookis ..... E04H 15/50 135/144
9,051,754 B2 * 6/2015 Mallookis ..... E04H 15/50
9,234,366 B2 * 1/2016 Mallookis ..... E04H 15/50
11,131,112 B2 * 9/2021 Frankel ..... E04F 10/04
2005/0205124 A1 * 9/2005 Goldwitz ..... E04H 15/50 135/131
2008/0017232 A1 * 1/2008 Zeigler ..... E04H 15/50 135/145
2010/0101617 A1 * 4/2010 Stehly ..... E04H 15/46 135/141
2018/0216361 A1 * 8/2018 Kerber ..... E04H 15/505

FOREIGN PATENT DOCUMENTS

FR 2753220 A1 * 3/1998 ..... E04H 1/1222

* cited by examiner

*Primary Examiner* — David R Dunn
*Assistant Examiner* — Danielle Jackson
(74) *Attorney, Agent, or Firm* — Furr Law Firm; Jeffrey M. Furr

(57) ABSTRACT

A simplified pop-up canopy and frame that allows for easy set and expansion. It is a modular and collapsible design. The design has a plurality of leg assembles which hold up a plurality of cross bar sets. The cross bar sets are connected to brackets which connection a plurality of cross bar sets together to form the pop-up canopy frame on which a canopy cover can be placed.

15 Claims, 25 Drawing Sheets

POP UP CANOPY

TECHNICAL FIELD

The technology discussed below relates generally to a Canopies, and more particularly to canopies that can be popped up/set up quickly as well as being able to be expanded quickly.

BACKGROUND

Many efforts and devices have been provided to make it easier to assemble a pop up canopy. In particular, efforts have been made to provide a canopy that is quick to set up and use. These efforts have included different metal frames or structure. Such structures, however, have often been relatively expensive or have been cumbersome to use, that they are not usually employed to be used. These issues are resolved by the present invention.

SUMMARY

The simplified pop up canopy and frame system of this disclosure provides for quick set up and take down as well as being easily expandable.

A simplified pop-up canopy and frame that allows for easy set and expansion. It is a modular and collapsible design. The design has a plurality of leg assembles which hold up a plurality of cross bar sets.

The design allows for the removal or movement of center poles allowing better access while adding additional strength and stability with unique cross bar sets with top bars that are connected to brackets to produce a frame on which a canopy cover can be placed.

A standard pop-up canopy would be 10 feet by 20 feet and can be connected with other standard pop-up canopy together to form larger structures without the need of center supports allowing for a completely open area underneath the canopy.

The design provides better stability allowing the user to quickly set up the canopy and leave it set up for extended periods of time.

List of Parts

1 pop-up canopy
10 cover
20 circular stabilizing weights
100 corner poles
110 foldable corner pole assemble
111 base
113 angled braces
114 angled support bars
120 cross bar sections
121 cross bars
122 cross bar pivot
125 sliding bracket
126 locking socket and pin
127 top bar pivot
128 locking mechanism
129 top bar
130 uprights
132 center point
135 diagonal support cables
140 lower pole bracket
150 higher pole bracket
160 top brackets
170 bottom brackets
180 support cable

200 truss
500 support pole
600 side line
650 cross lines

DRAWINGS

Figure 4A:
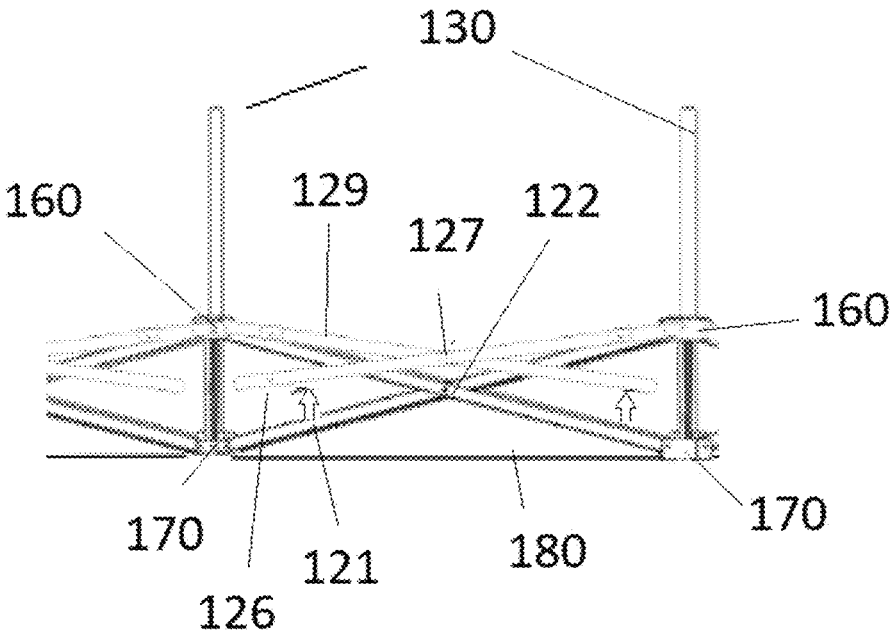

FIG. 4*a* is a side view of the frame lattice closing.

Figure 4B:
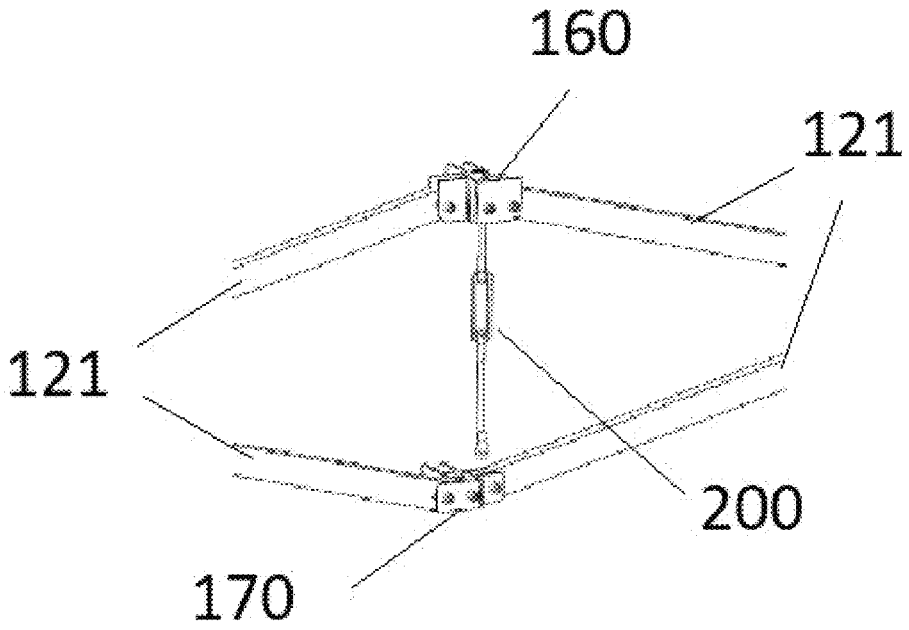
Figure 4C:
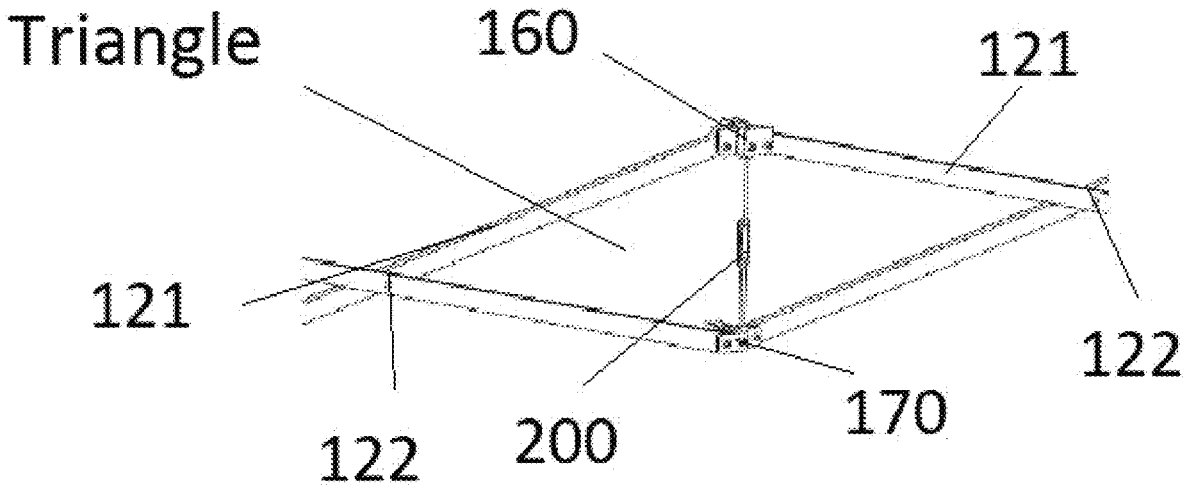

FIGS. 4*b* and 4*c* show the cross frames being set up.

Figure 5:
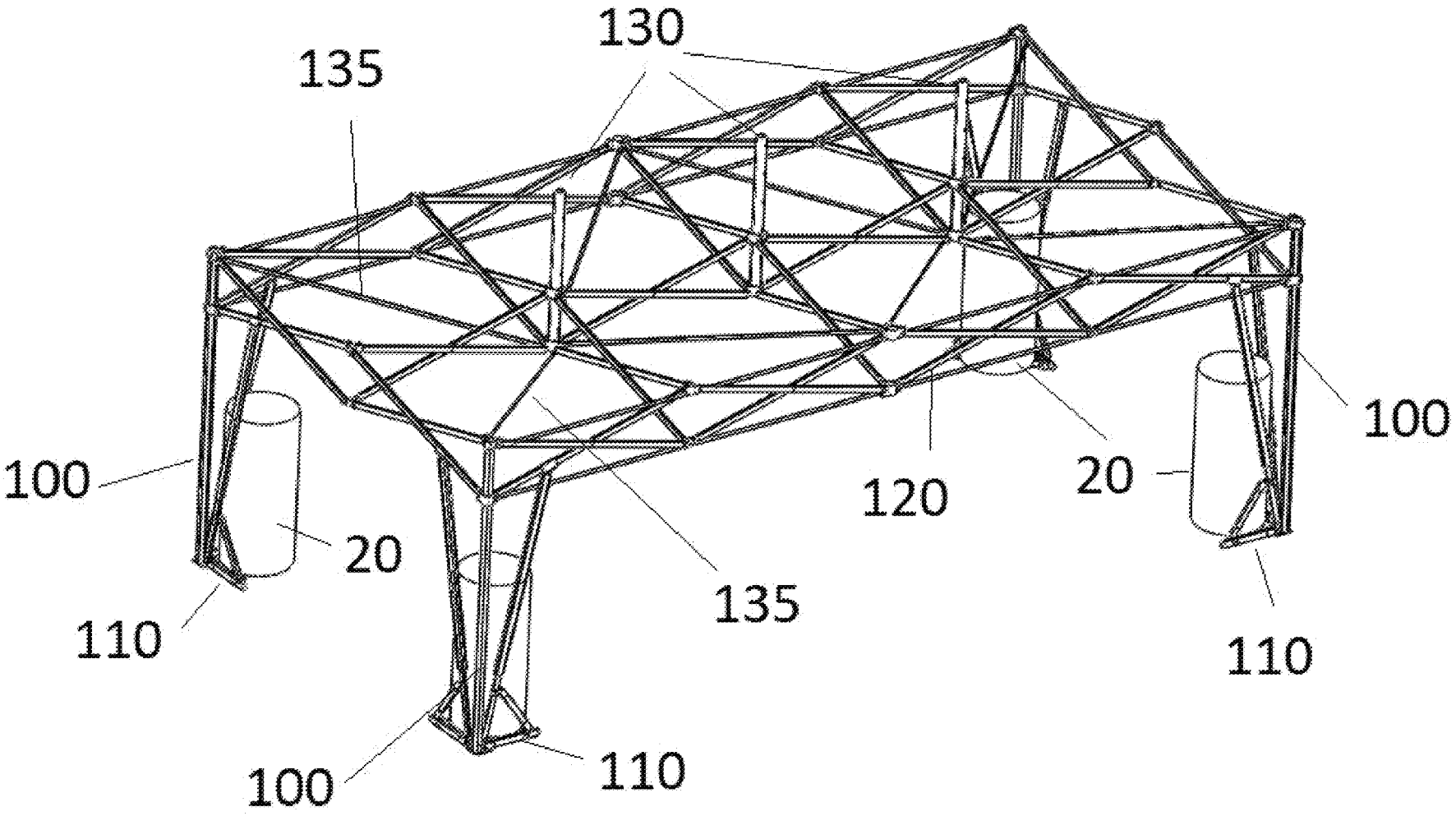

FIG. 5 is an elevated view of the frame.

Figure 6:
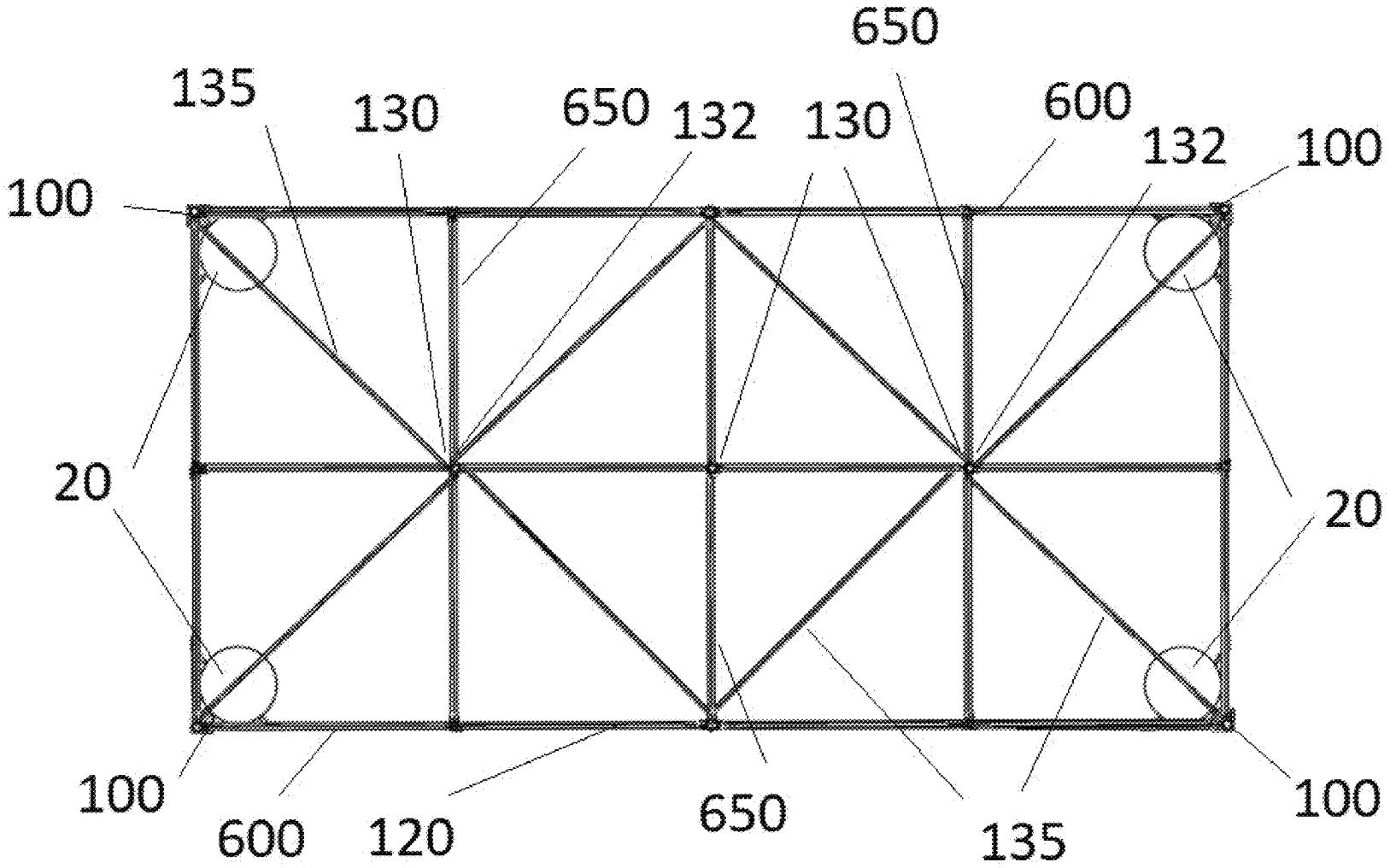

FIG. 6 is a top view of the frame of the pop up canopy.

Figure 7:
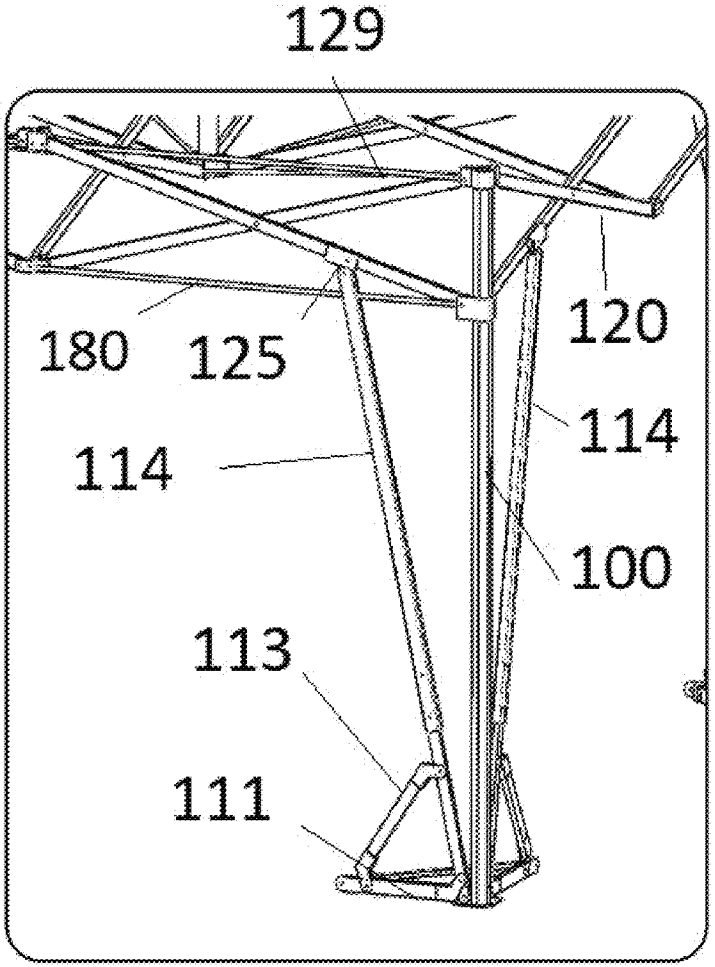

FIG. 7 is a view of the frame corners.

Figure 8:
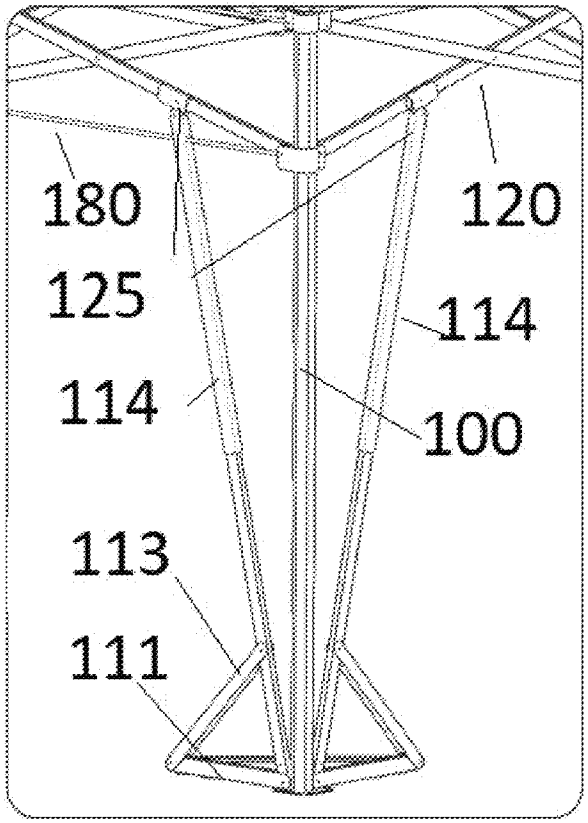

FIG. 8 is another view of the frame corners.

FIG. 9*a-h* shows the elements of the frame corners.

Figure 10A:
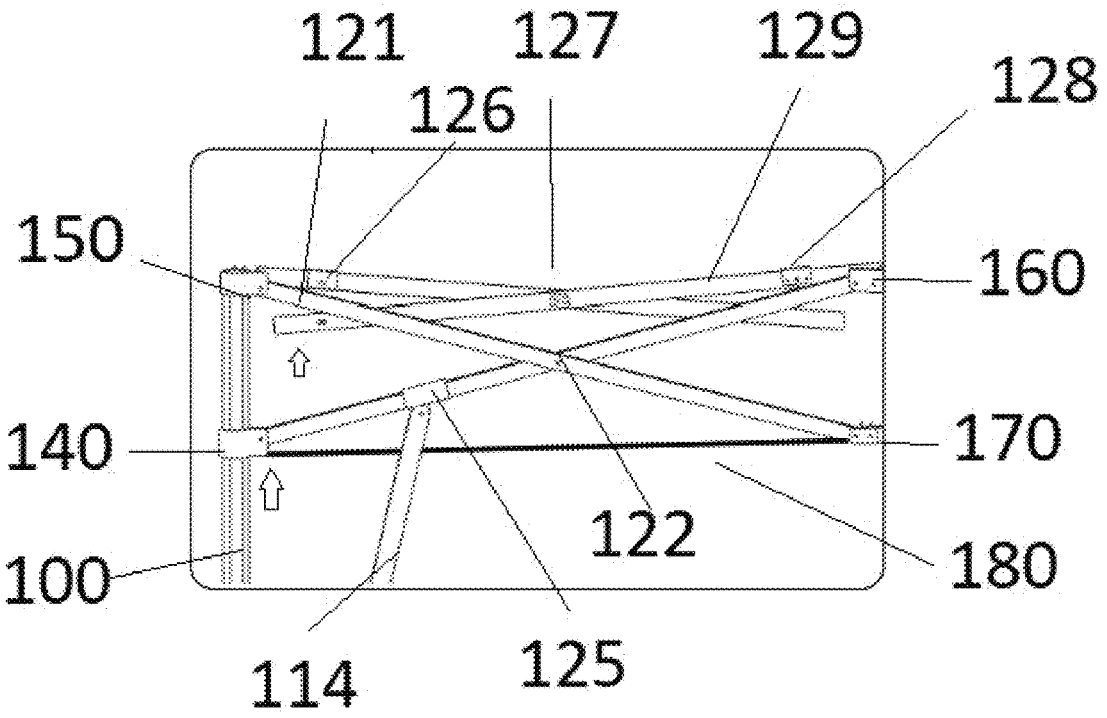
Figure 10B:
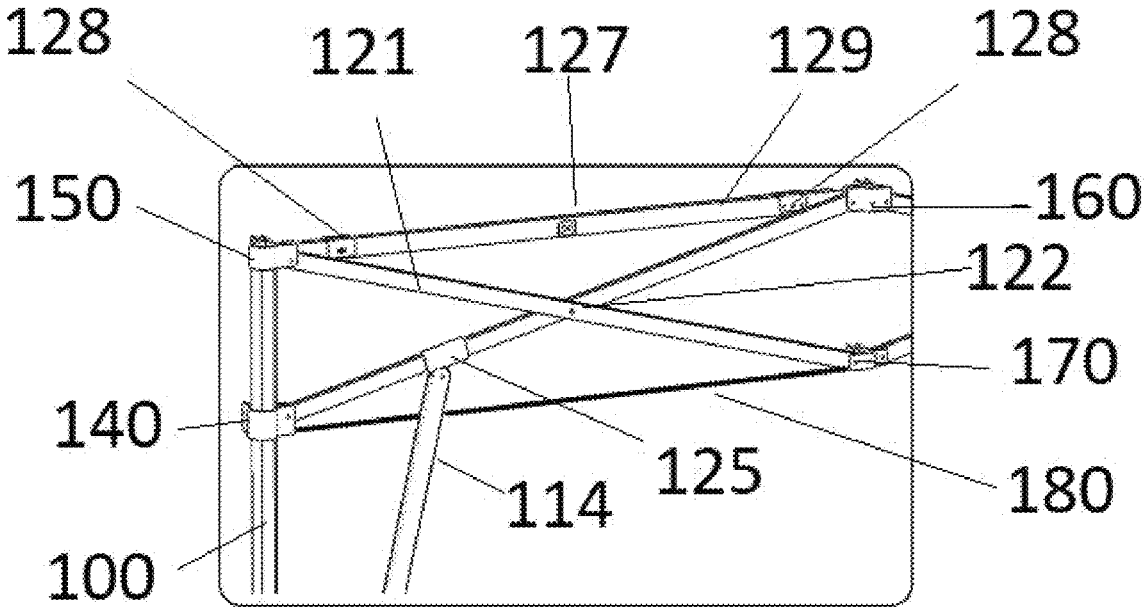

FIG. 10*a* and FIG. 10*b* shows the frame lattice

Figure 11:
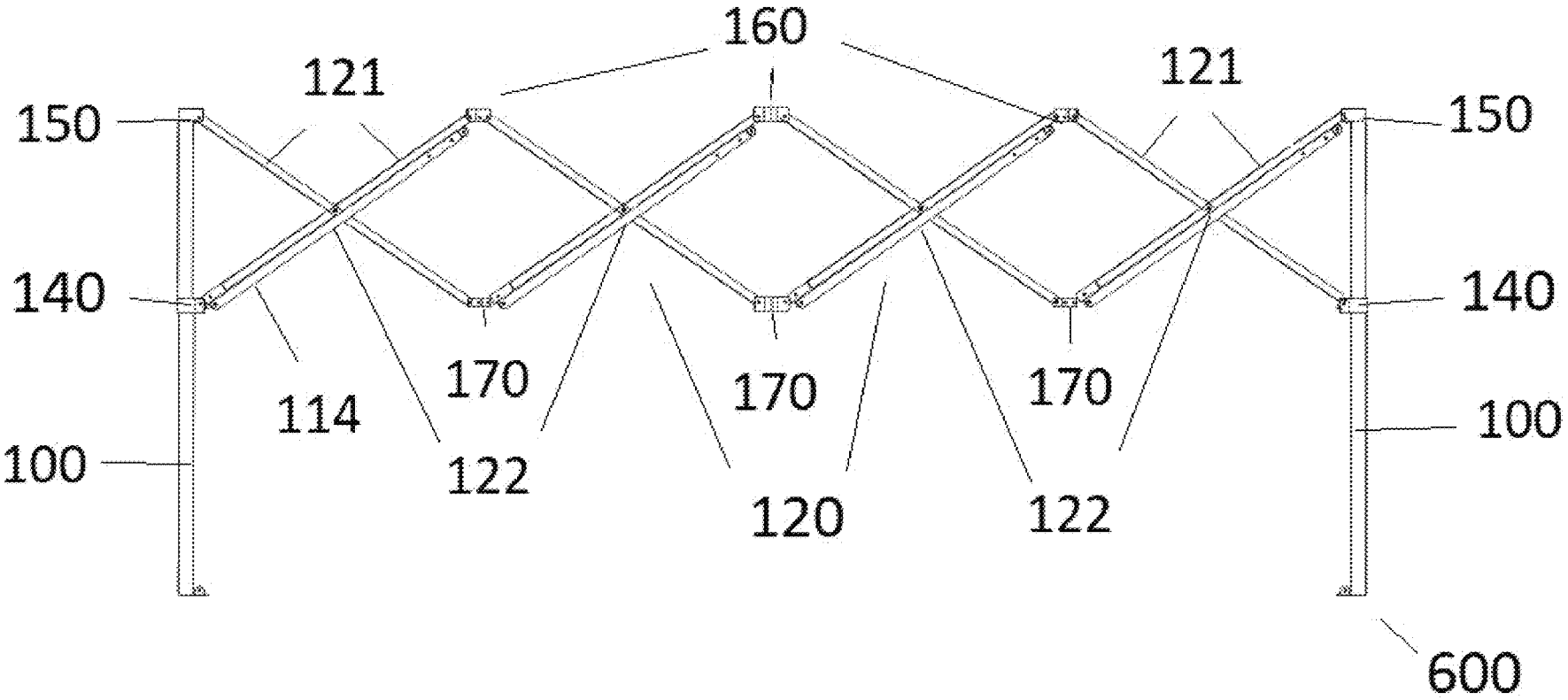

FIG. 11 shows a side cross bar line.

Figure 12B:
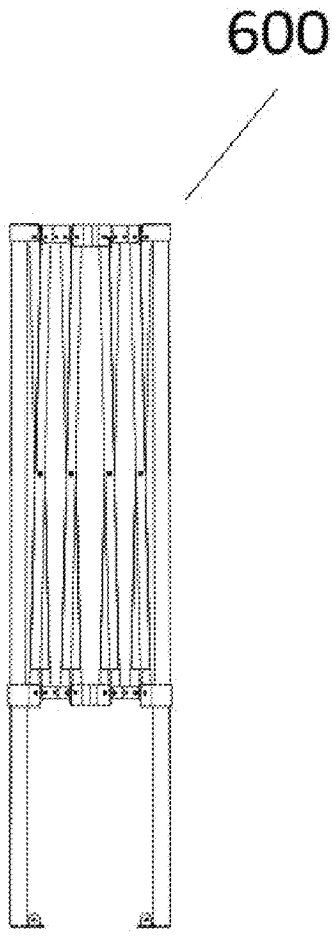
Figure 12A:
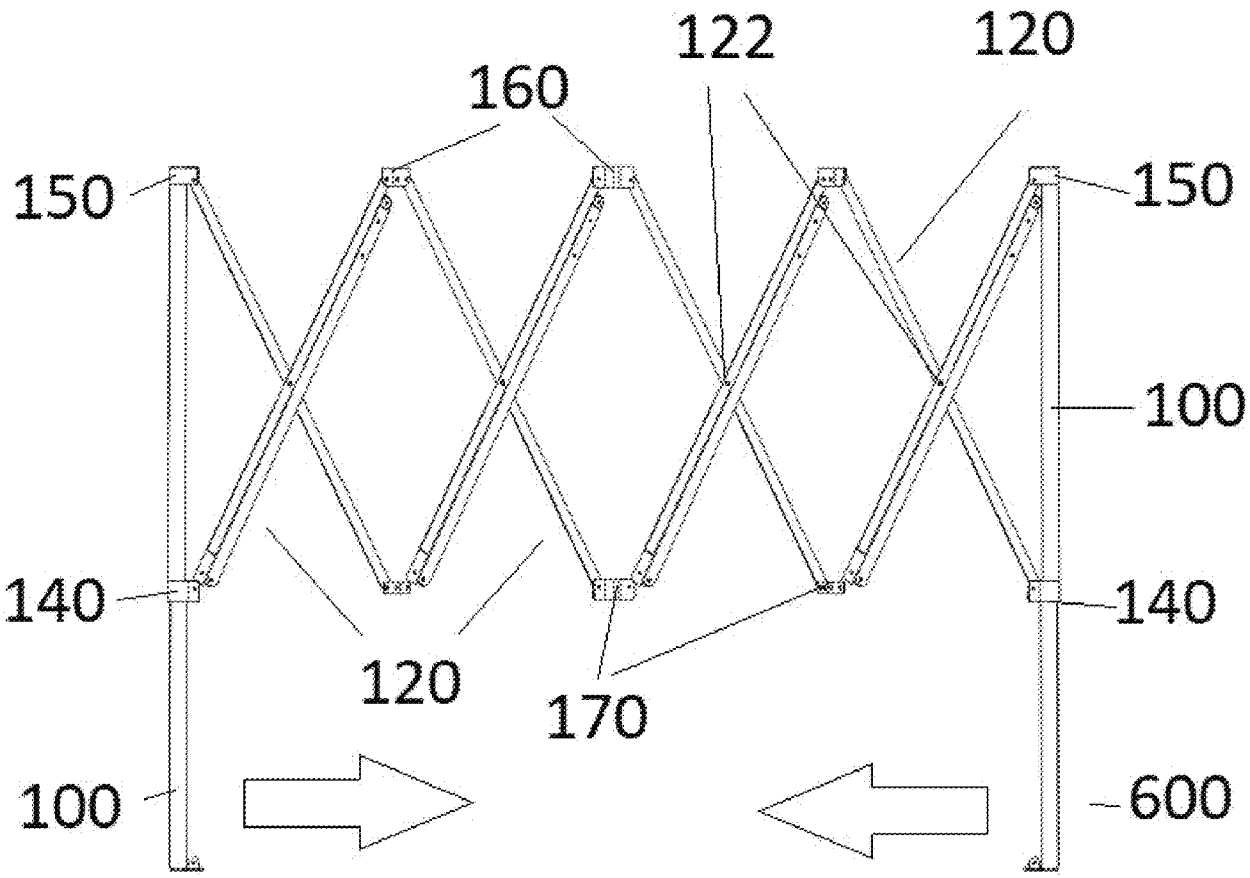

FIGS. 12*a* and 12*b* shows the line being folded.

Figure 12D:
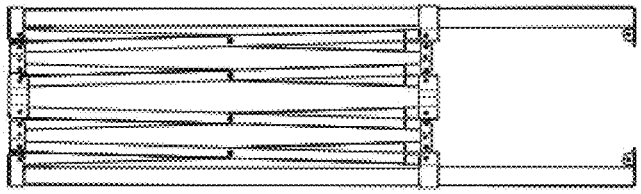
Figure 12C:
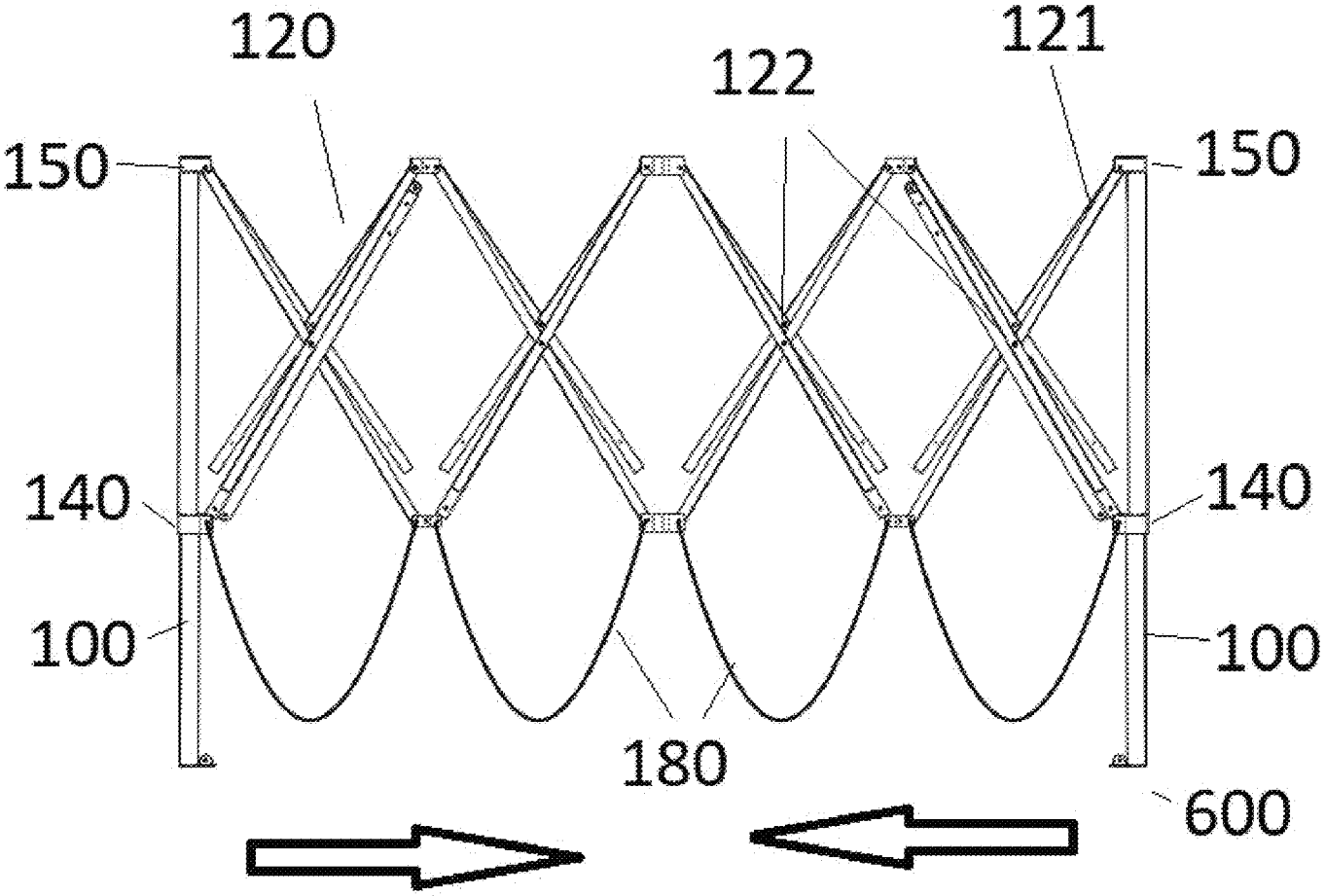

FIGS. 12*c* and 12*d* shows the line being folded with support cables.

Figure 12E:
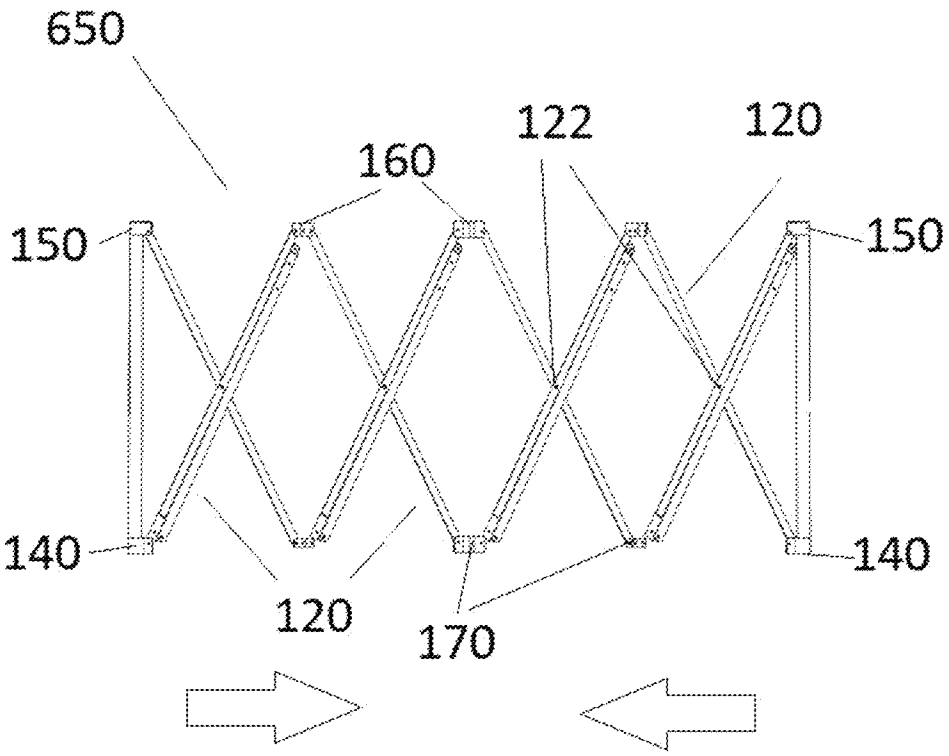

FIG. 12*e* shows a middle cross bar line.

Figure 13:
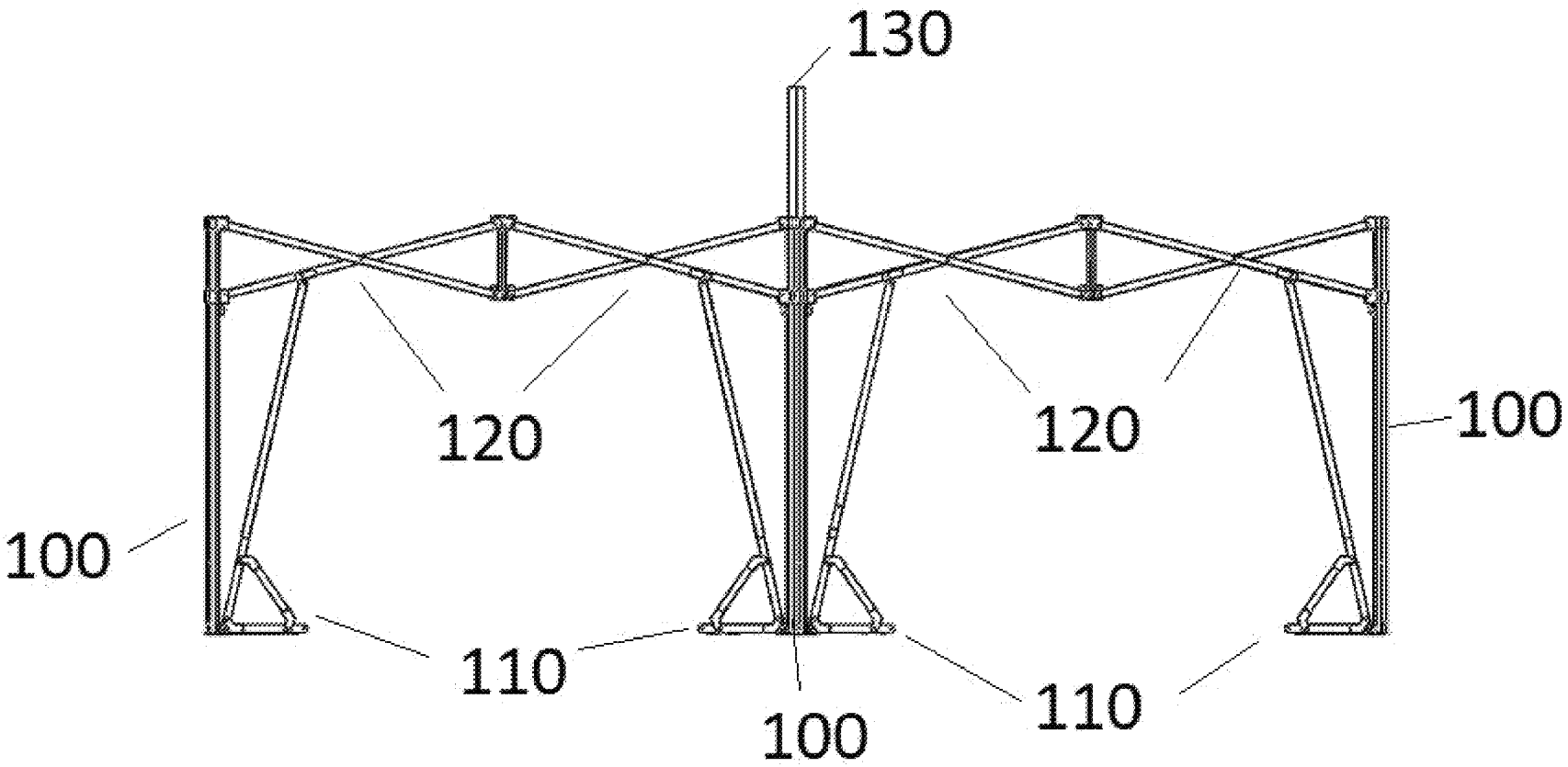

FIG. 13 shows an embodiment of the frame.

Figure 14:
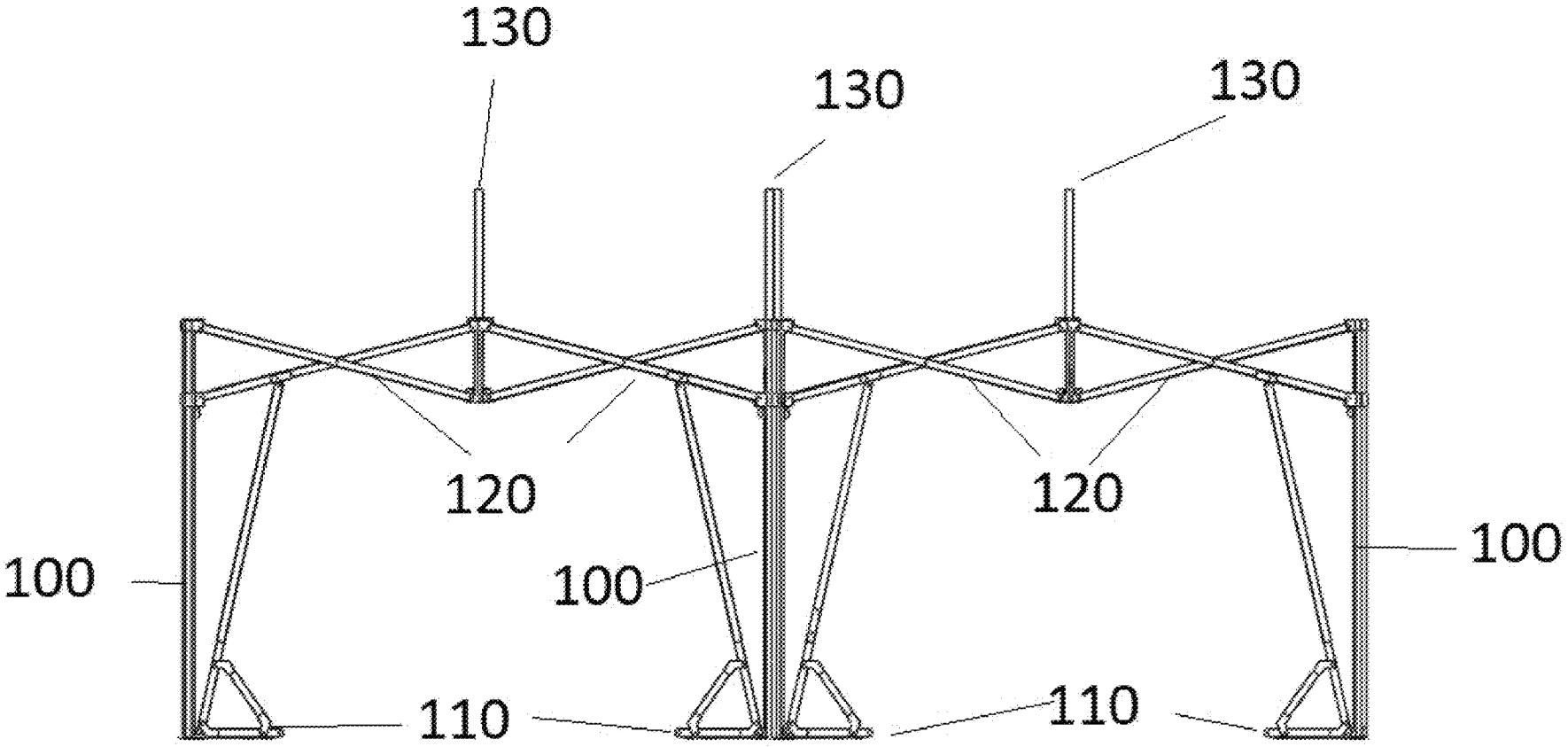

FIG. 14 shows another embodiment of the frame.

Figure 15:
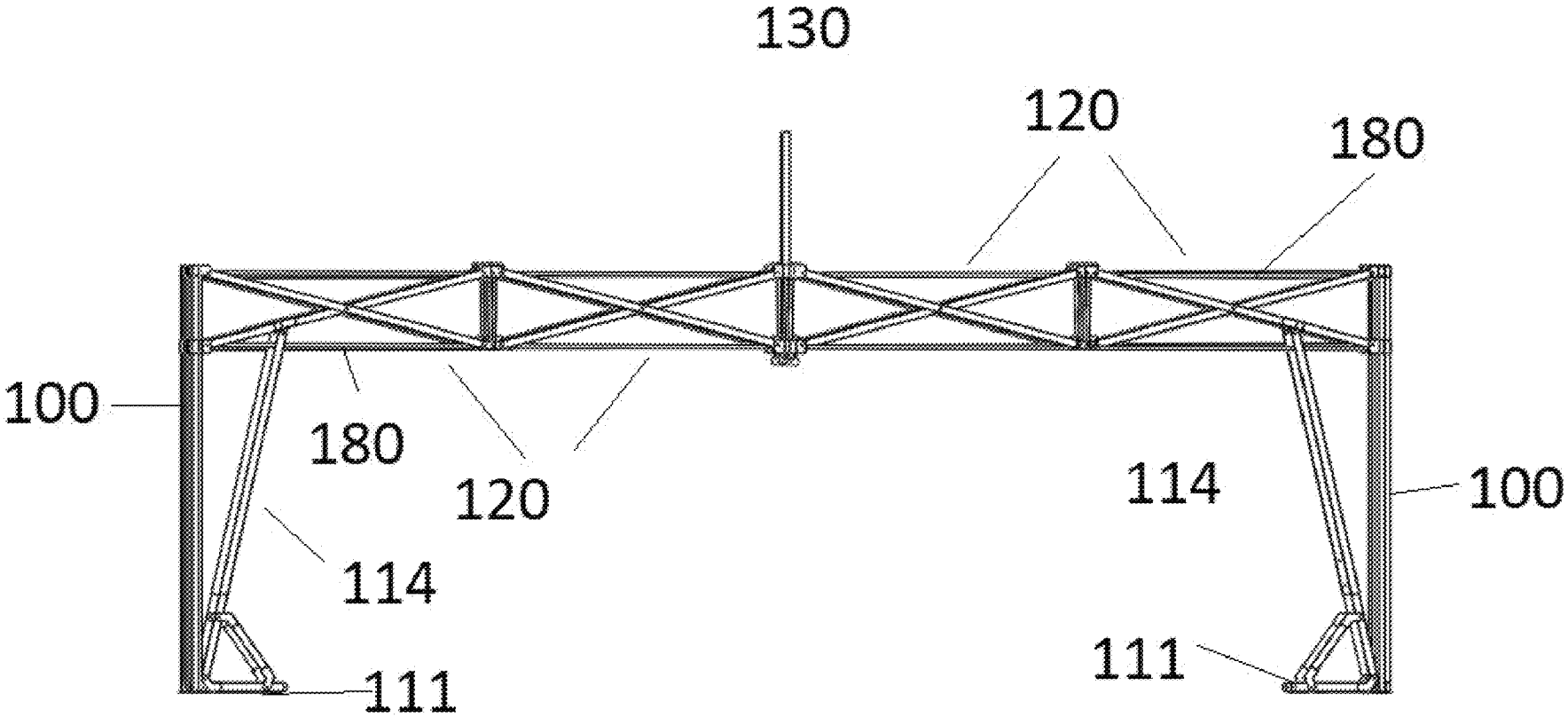

FIG. 15 shows an additional embodiment of the frame.

Figure 16A:
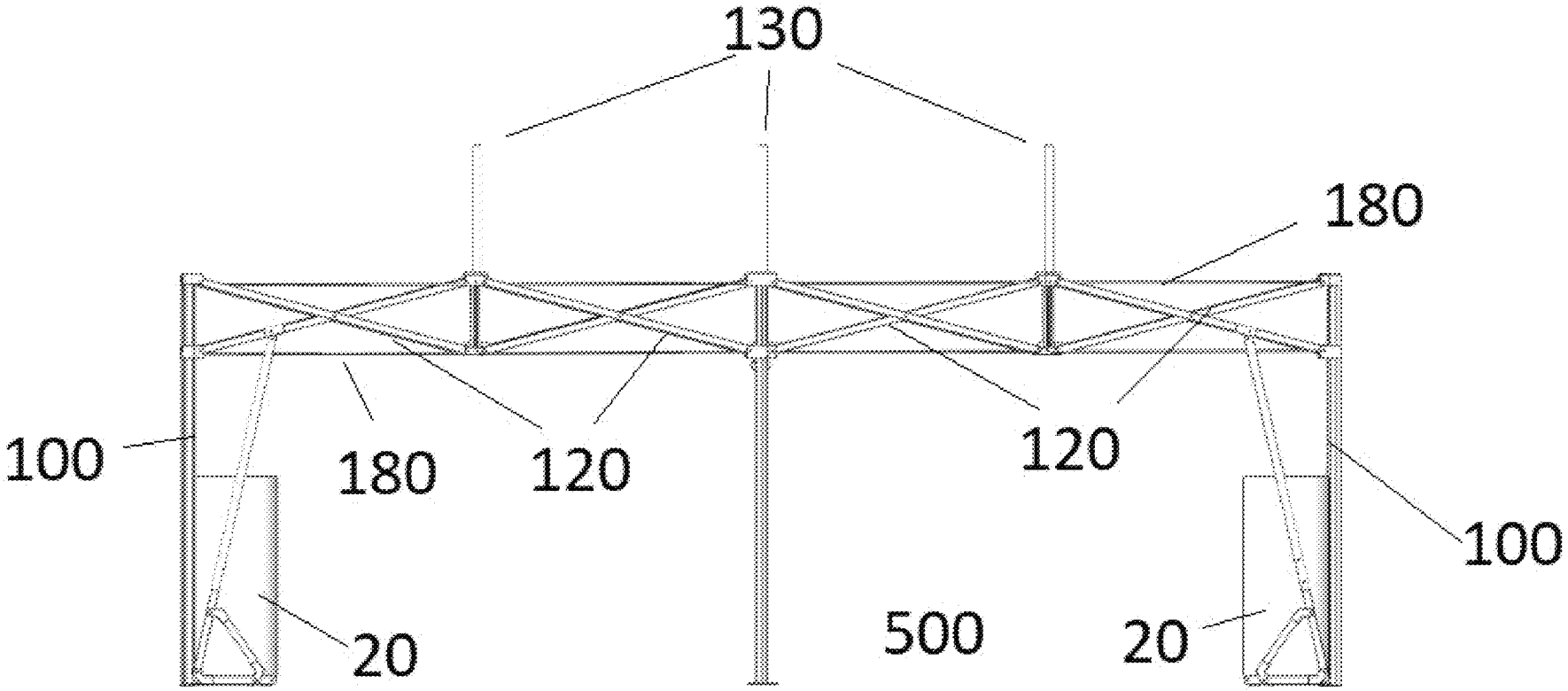
Figure 16B:
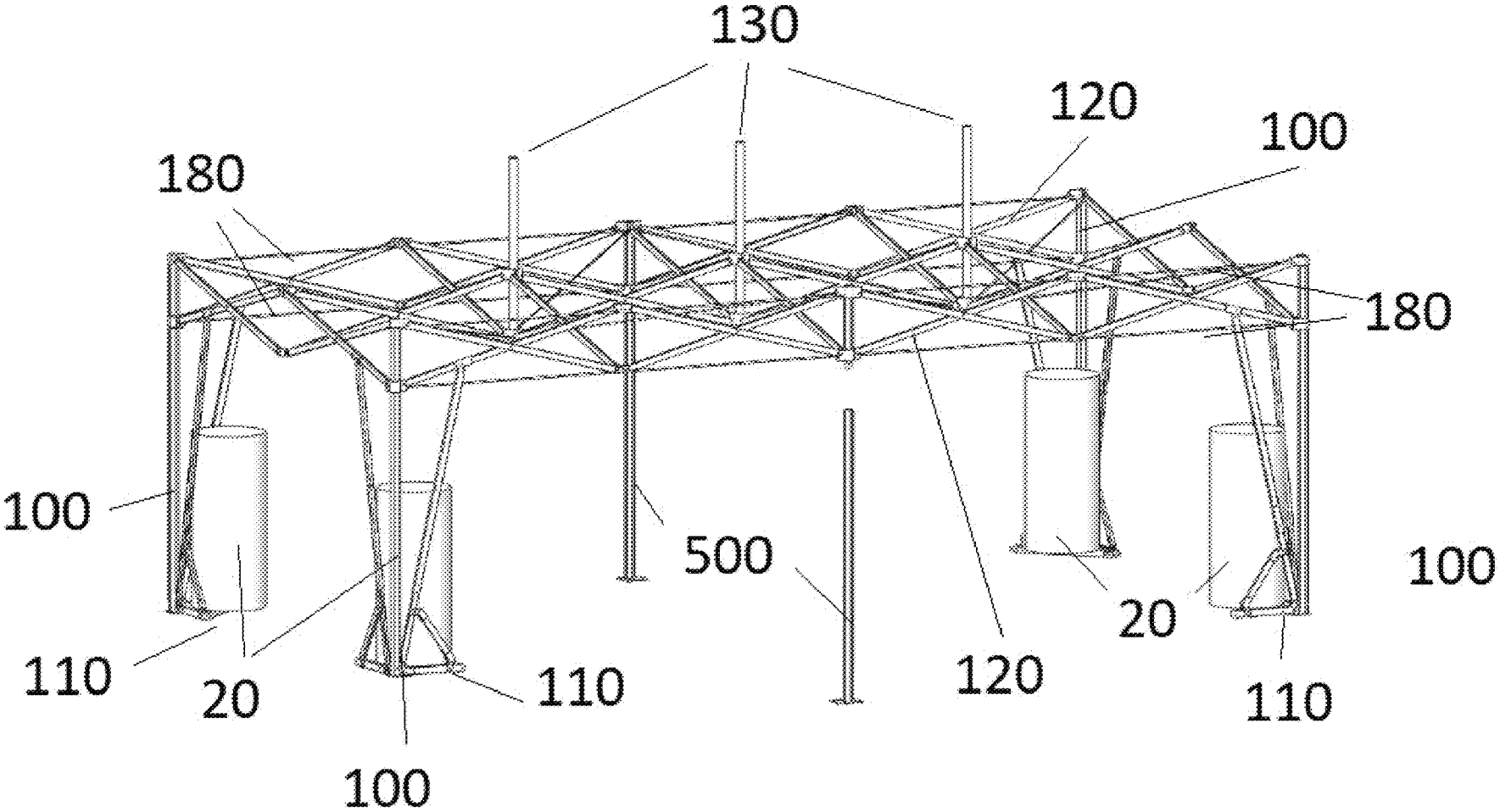

FIGS. 16*a* and 16*b* shows an embodiment with center poles.

Figure 17:
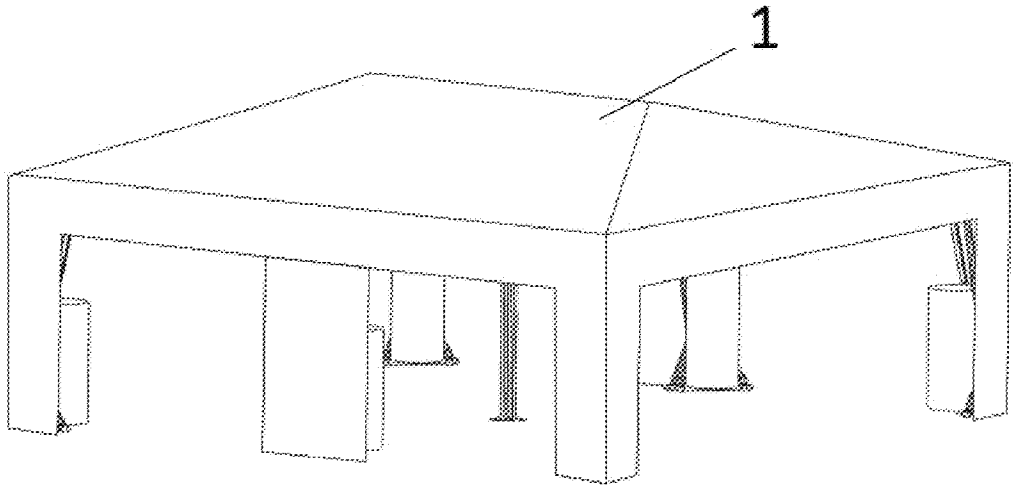

FIG. 17 shows an embodiment with a canopy.

Figure 18:
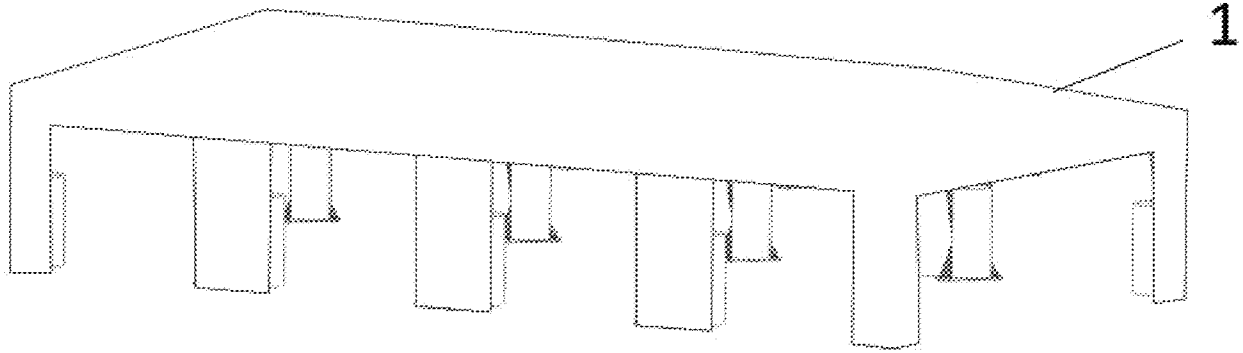

FIG. 18 shows an embodiment with sections connected together.

Figure 19:
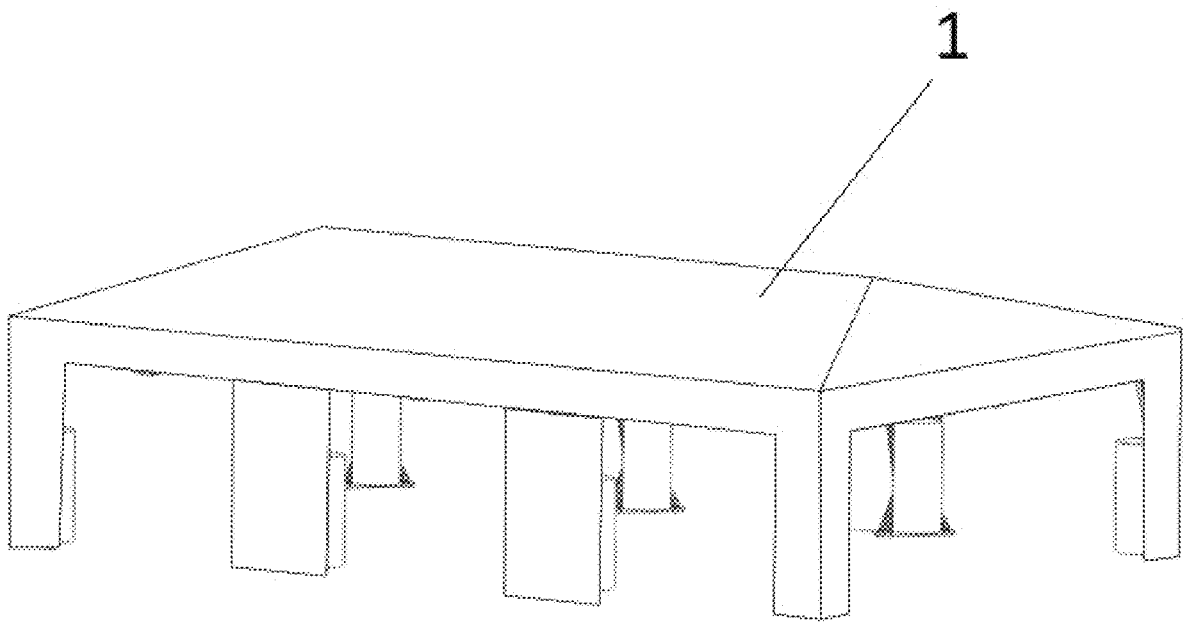

FIG. 19 shows an additional embodiment with a canopy.

Figure 20:
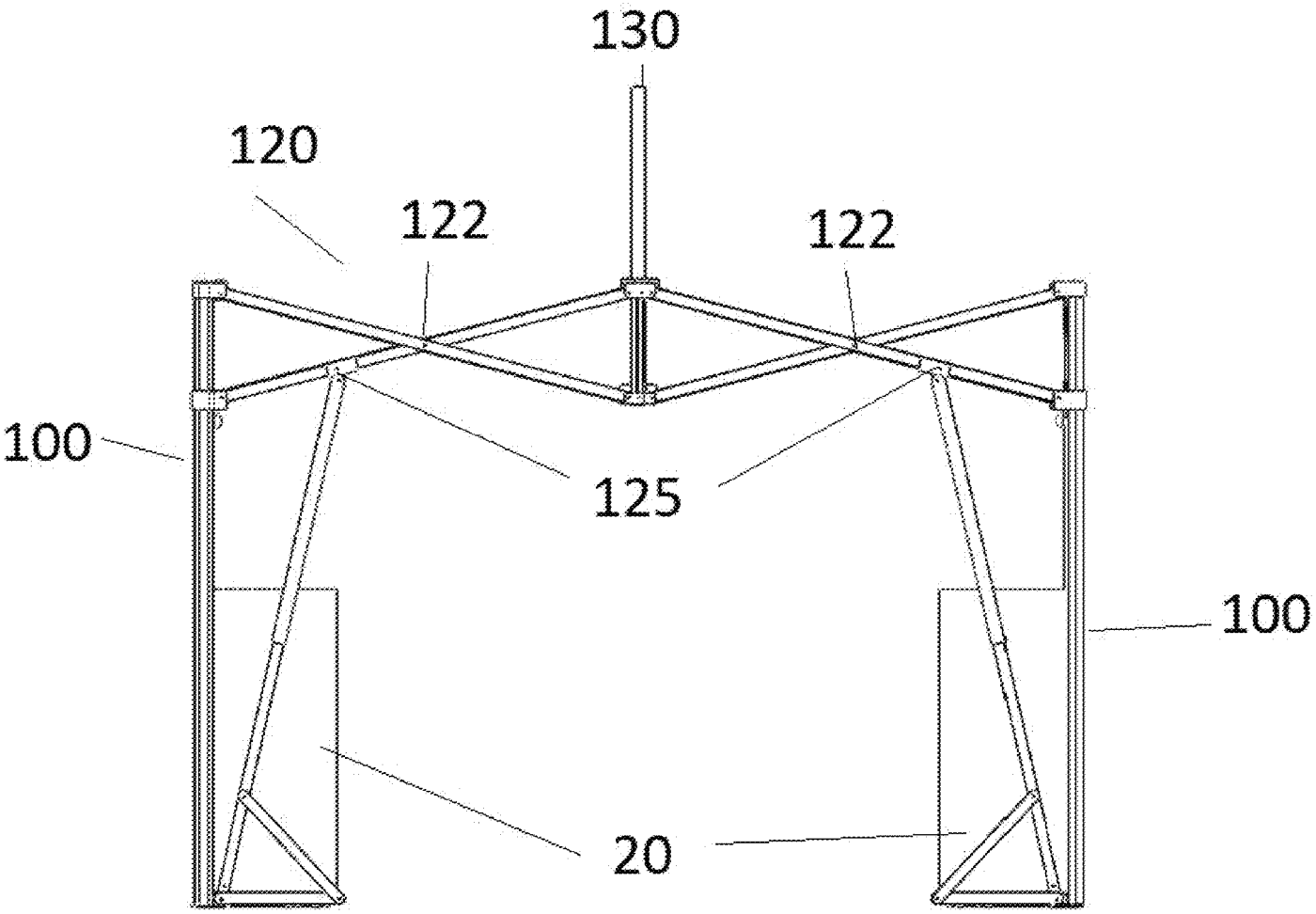

FIG. 20 shows a short side view of the frame.

DETAILED DESCRIPTION

The illustrations presented herein are, in some instances, not actual views of any particular framing devices or components thereof, but may be idealized representations which are employed to describe the present disclosure. Additionally, elements common between figures may retain the same numerical designation.

The pop-up canopy 1 of the current invention as shown in FIGS. 1 through 20.

The pop-up canopy 1 is rectangular in shape in the preferred embodiment.

Figure 1:
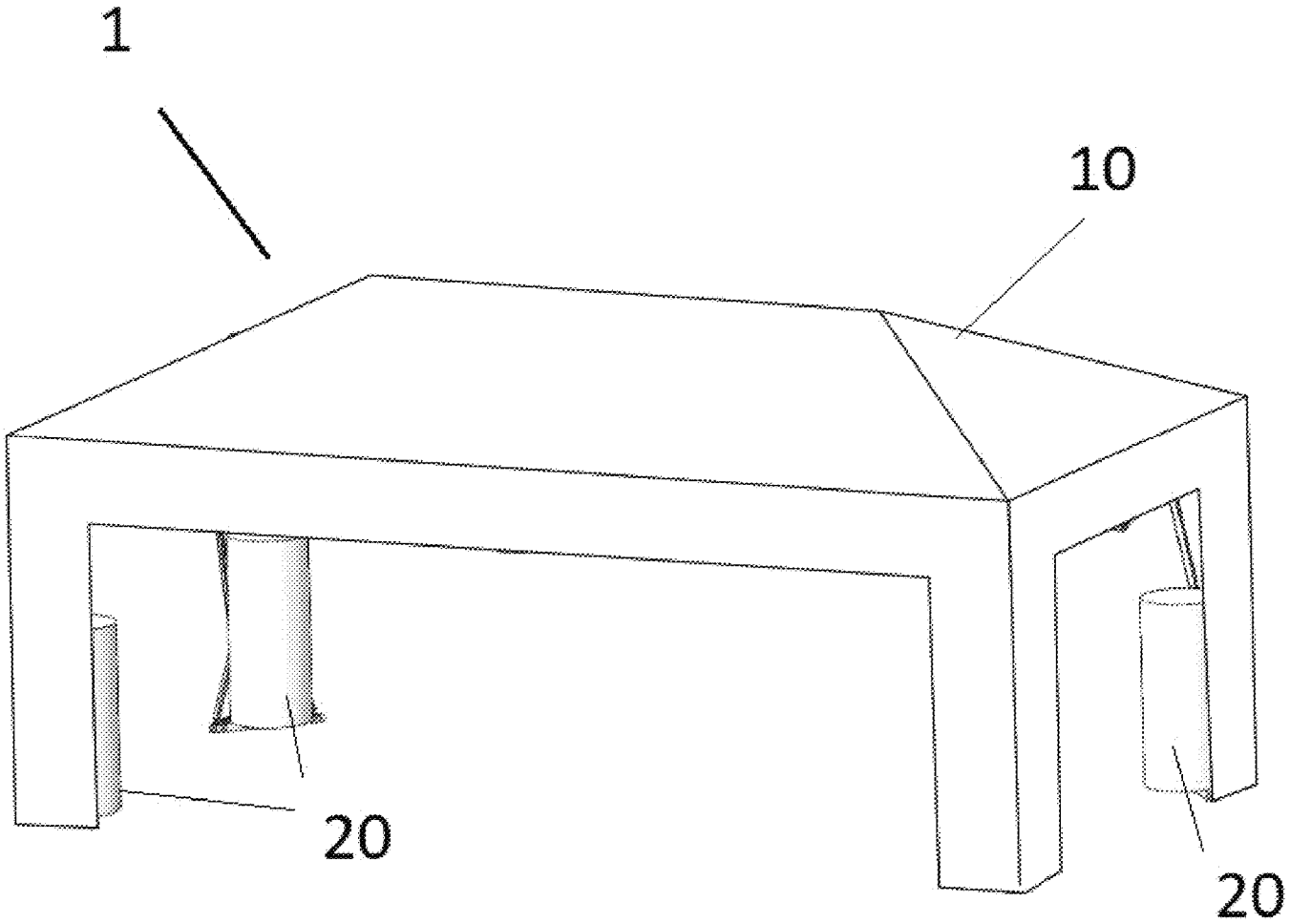
FIG. 1 is view of the pop up canopy with a cover.

FIG. 1 displays the pop-up canopy 1 with the cover 10 over the frame with circular stabilizing weights 20 in the corners of the pop-up canopy 1 to hold the pop-up canopy 1 down. Spikes can also be used instead of or in addition to the circular stabilizing weight 20. In the preferred embodiment the dimensions would 10 feet by 20 feet and would be expandable by combining additional pop-up canopies 1 or by adding additional cross bar sections 120.

Figure 2:
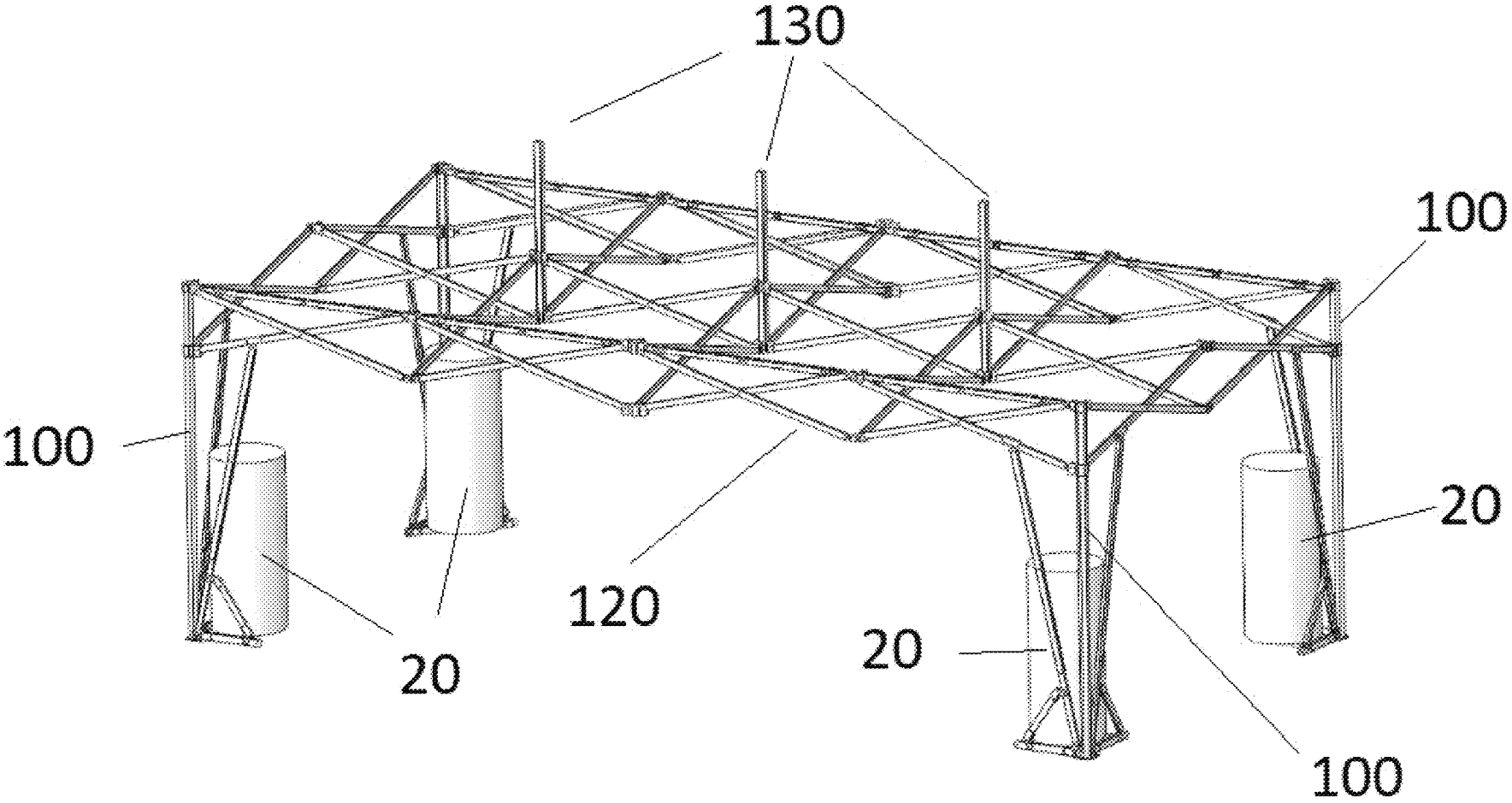
FIG. 2 is a detail view in perspective of the frame of the pop up canopy.
Figure 3:
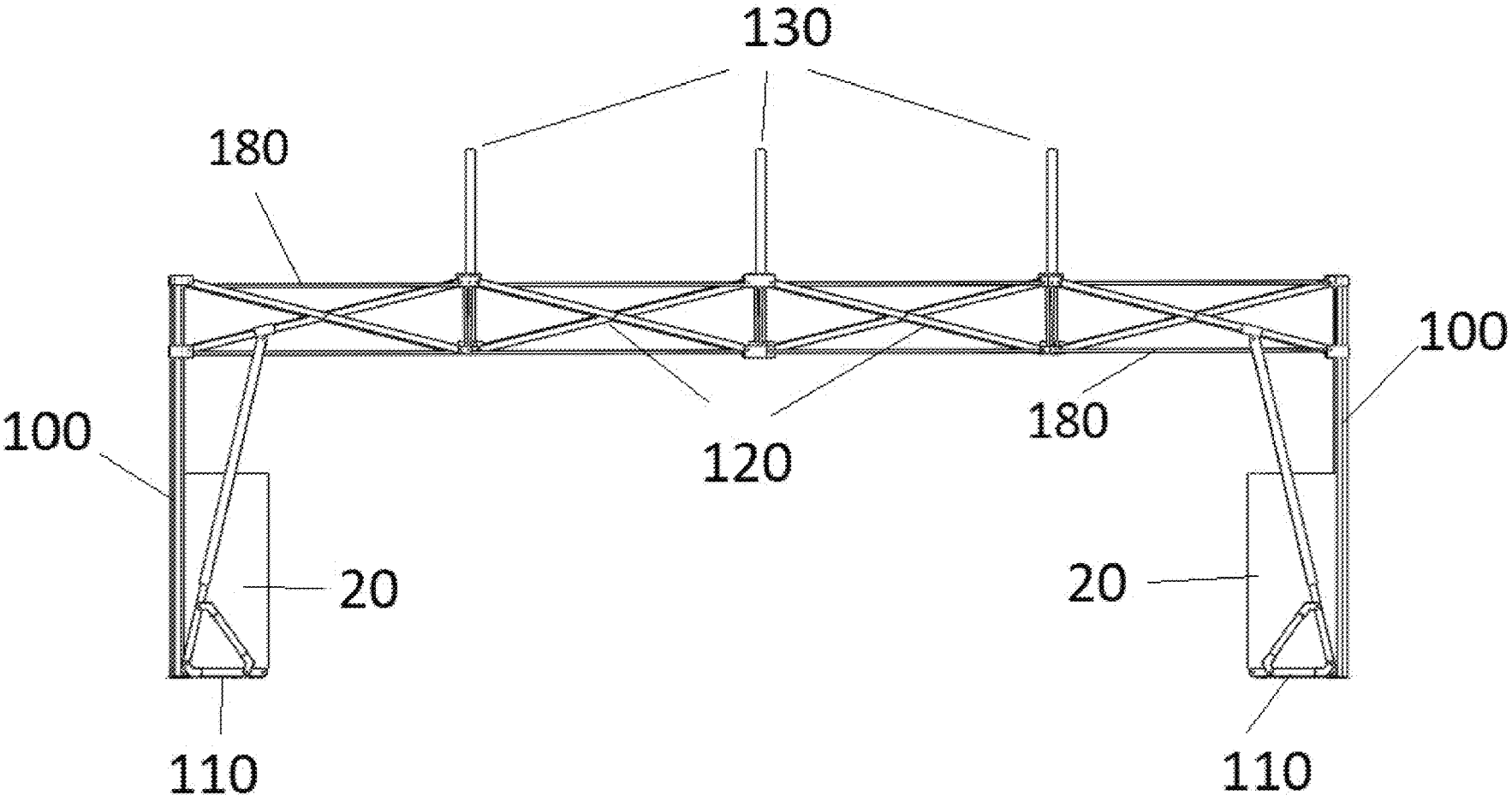
FIG. 3 is a side view of the frame of the pop up canopy.

FIGS. 2, 3 and 5 shows a standard configuration frame for the pop-up canopy 1. The frame will have four corner poles 100 which are part of a foldable corner pole assemble 110. Each side of the canopy 1 has a plurality of cross bar sections 120 forming a side line 600 as well as a plurality of cross lines 650 formed of cross bar sections 120 running perpendicular from the side lines 600.

Extending out from the top of the frame from the brackets 160, 170 that connect the cross bar sections 120 are one or more movable uprights 130. The uprights 130 hold up the cover 10 to give the canopy sloping sides if wanted. FIGS. 2, 3, and 5 shows a configuration with three uprights 130 in the center of the canopy 1.

The circular stabilizing weights 20 rest on the corner pole assemble base 111 to hold it down. In the preferred embodiment the circular stabilizing weights 20 are closed hollow cylinders made of a durable material that can be filed with liquids or solids like water and sand to add weight for better stability.

FIG. 4*a* shows a cross bar section 120, a "X" section. A cross bar section 120 in the preferred embodiment has two cross bars 121 that are connected in the middle of the bars by a cross bar pivot 122. The cross bars 121 are flat bars made of a strong light weight material. The cross bars 121 are connected to top brackets 160 and bottom brackets 170. The cross bar section 120 has a support cable 180 that run through the series of bottom brackets 170 and a top bar 129 or support cable 180 through a series of top brackets 160. The cross bar sections 120 are connected to each other through the top brackets 160 and the bottom brackets 170. The cross bars 121 are connected to the brackets 160 through a pivotal connection means such as a pivot allowing the cross bars 121 to fold together while preparing for storage.

In the preferred embodiment, the cross bar section 120 has a top bar 129 between the top brackets 160 and a support cable 180 running between the bottom brackets 170.

The configuration of solid top bars 129 at the top of the cross bar section 120 and support cable 180 strengthens structure of the set up pop-up canopy 1. The top bar 129 works against the downward pressure and the support cable 180 works against the compression forces of the pop-up canopy 1.

The movable uprights 130 extend out of the top brackets 160 and are located where the user wants to place them to support the cover 10.

In the preferred embodiment, the top bracket 160 and the bottom bracket 170 are connected through a connection means which in the preferred embodiment would be a truss 200 which can be adjustable with an adjustment means such as an adjustable turnbuckle as shown in FIGS. 4*b* and 4*c*. The truss 200 forms a triangular structure with the cross bars 121 as a triangular structure is one of the strongest structure configurations.

Using a turnbuckle as a truss 200 allows the user to turn the turnbuckle to adjust the height to insure a proper fit between the top bracket 160 and the bottom bracket 170.

FIG. 6 shows the side lines 600 and the cross lines 650. The cross lines 650 extend perpendicular from the side lines 600 with two cross lines 650 cross at a center point 132.

FIG. 6 shows a top view of the frame of the canopy 1 with the cross bars sections 120 with diagonal support cables 135 that run diagonally from the corners and sides to the center point 132 of squares or rectangles formed by plurality of cross bar sections 120 as shown FIGS. 5 and 6. The diagonal support cables 135 are a tighten means that provides structure to keep that frame 1 rigid and to prevent racking.

FIGS. 7 and 8 show an assembled collapsible/foldable corner assembly. The corner assembly has a base 111 consisting of a triangle of bars that rest on the ground. The base 111 has two angled braces 113 that connect to a pair of angled support bars 114 that connect to the bottom of the base 111. The angled braces 113 can be straight as shown in FIG. 8 or have angled ends as shown in FIG. 7. The angled ends bends at the ends and are straight in the middle. The angled braces 113 connect the base 111 to the lower part of the angled support bars 114 to hold the angled support bars 114 steady. The corner post 100 is also connected to the base 111 and is perpendicular to the ground. The angled support bars 114 connect to one of the cross bars 121 with a sliding bracket 125 that can slide along the cross bar 121 it is attached to. In the preferred embodiment the angled support bars 114 has an adjustable length.

The angled support bars 114 fold so they are collapsible and give the frame 1 strength so that it does not rack.

Figure 9B:
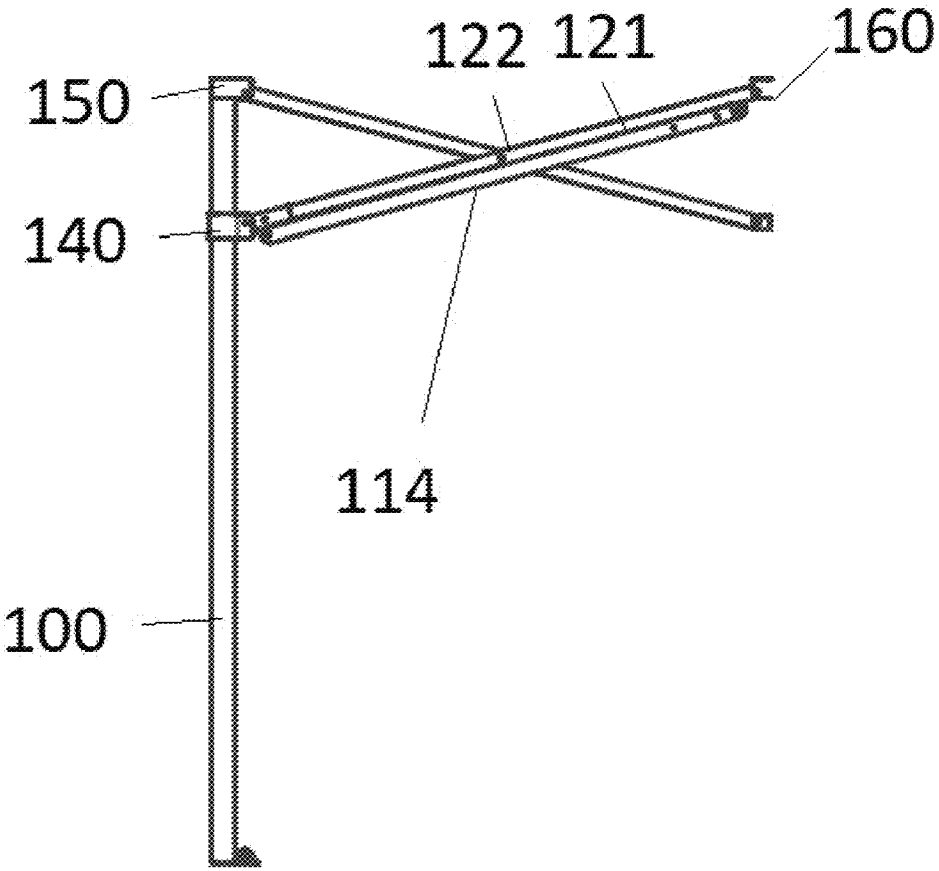
Figure 9A:
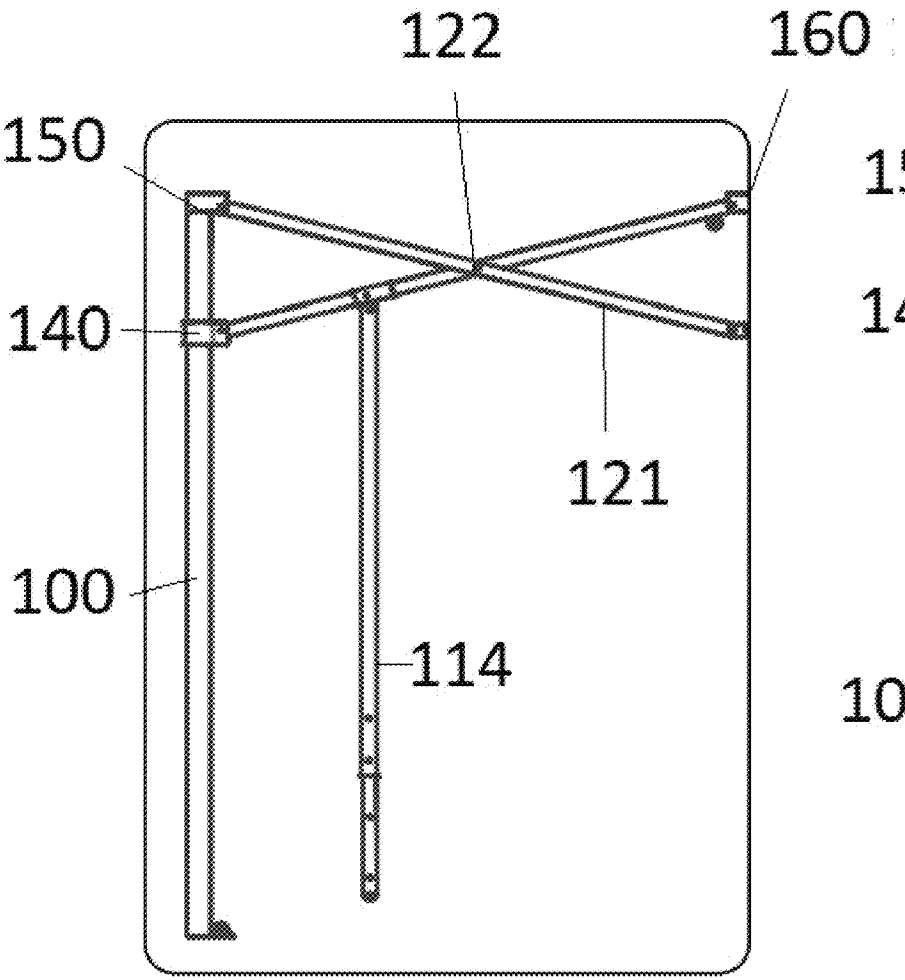

FIGS. 9*a*, 9*b*, 9*c*, 9*d*, 9*e*, 9*f*, 9*g* and 9*h* show the corners of the canopy 1 and how it attaches FIG. 9*a* shows the corner post 100 being connected to a cross bar section 120. The cross bars 121 connect to a lower pole bracket 140 and a higher pole bracket 150 with a sliding bracket 125 connecting the angled support bar 114 to the cross bar 121. FIG. 9*b* shows the angled support bar 114 folded up next to the cross bar 121 it is attached to.

Figure 9D:
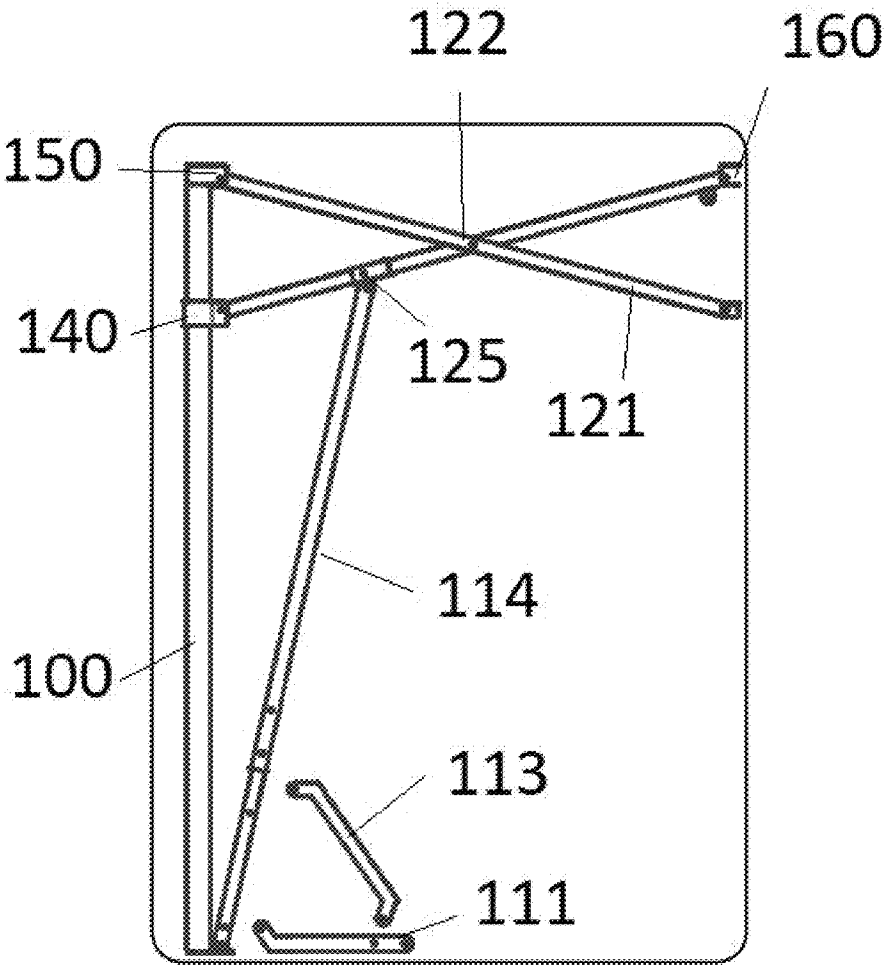
Figure 9C:
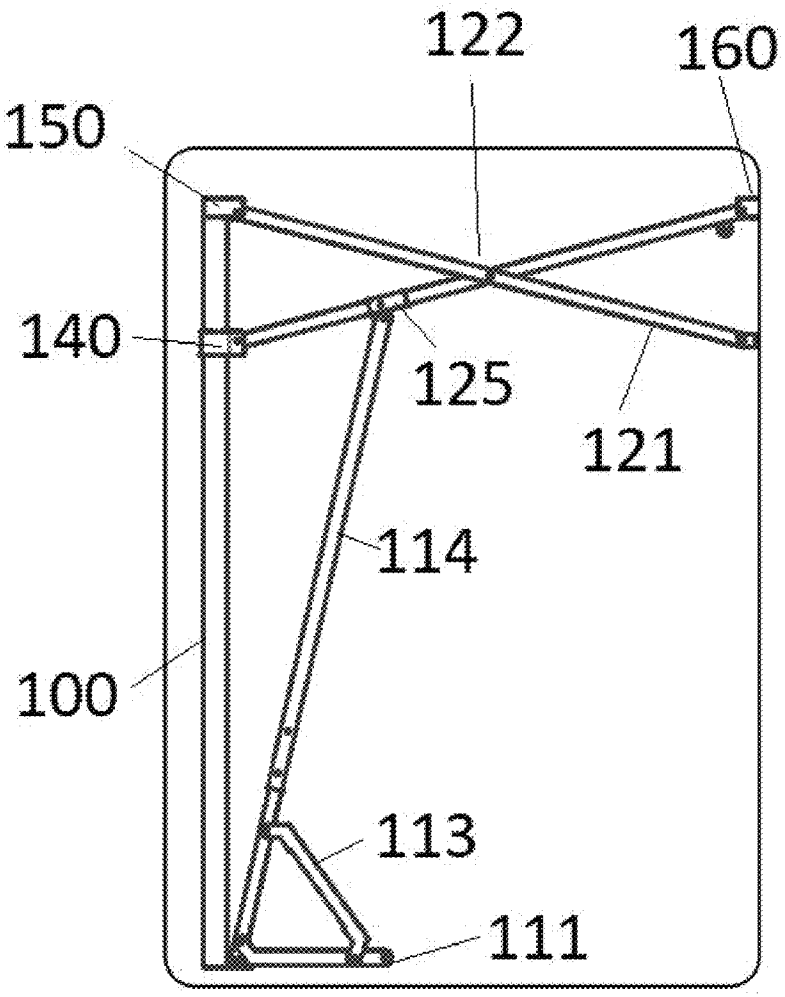
Figure 9F:
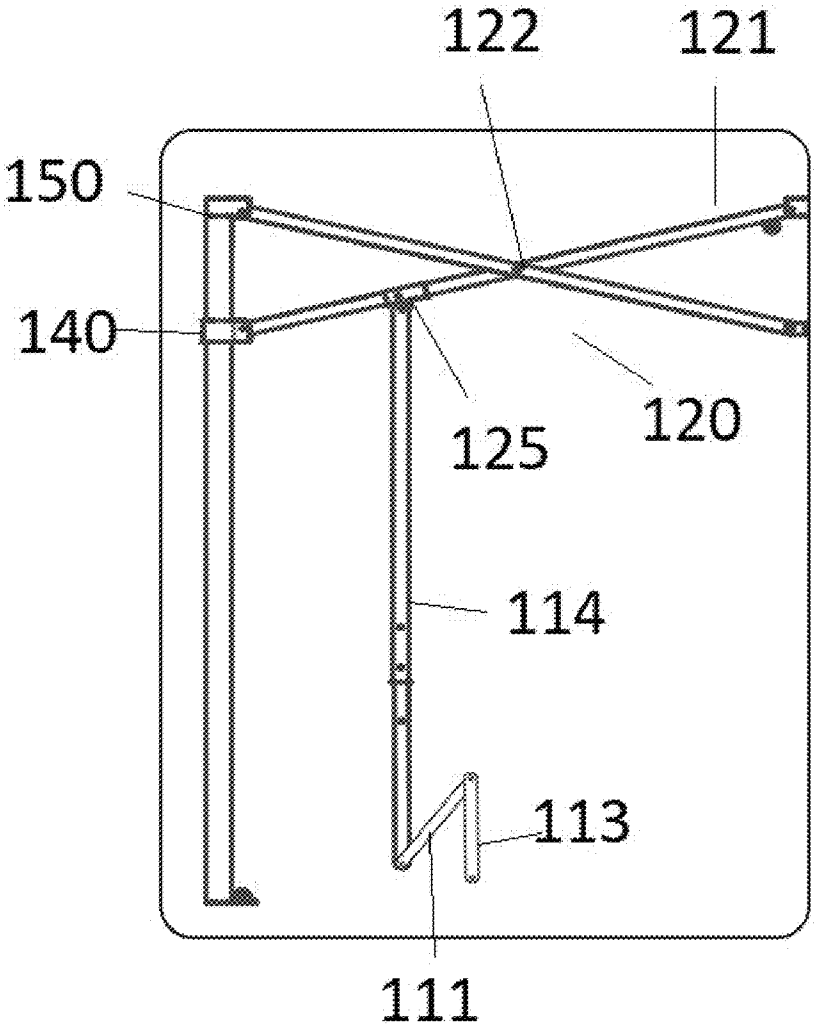
Figure 9E:
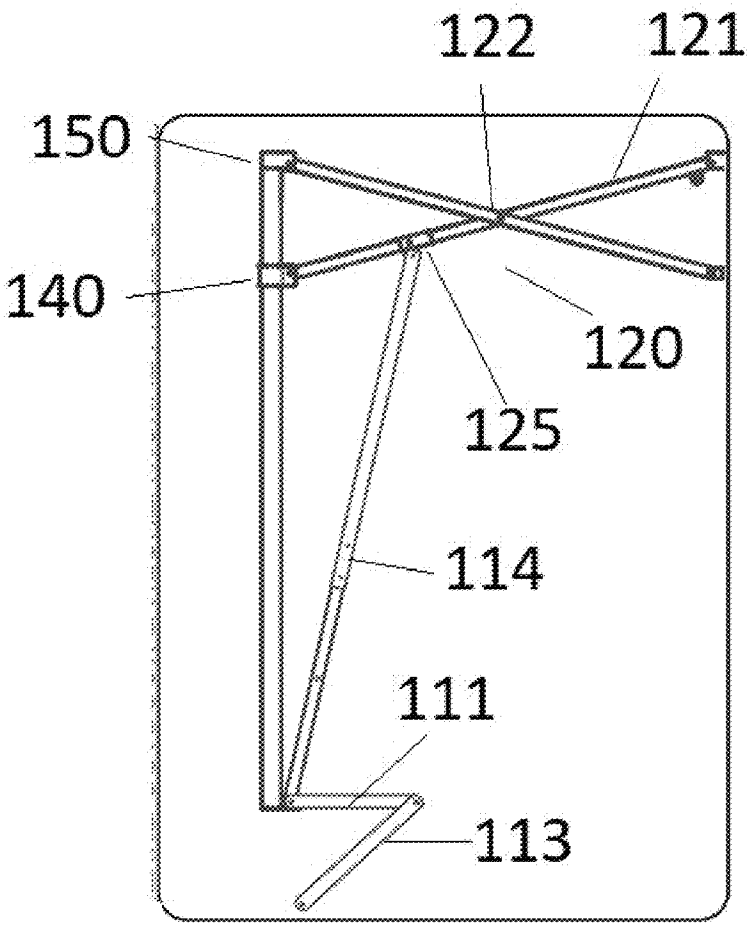
Figure 9H:
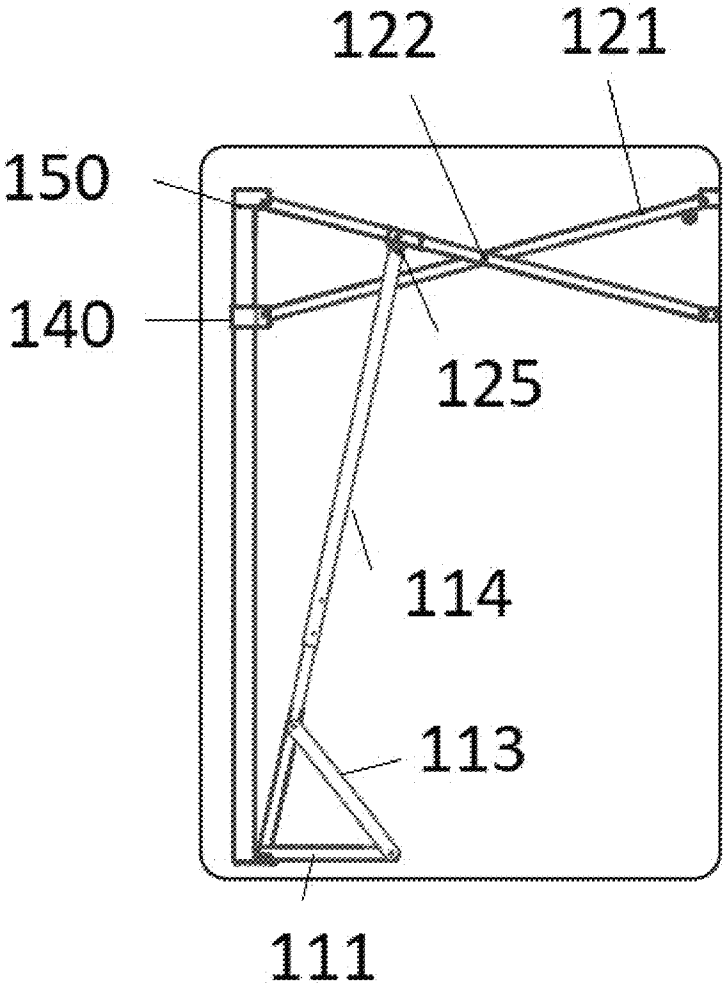
Figure 9G:
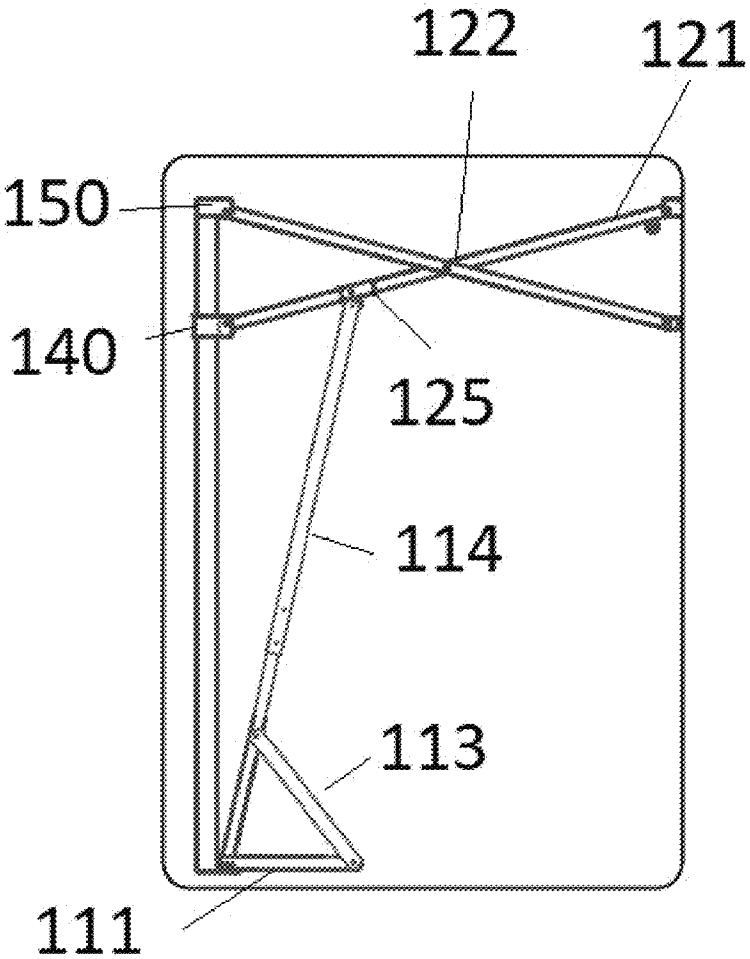

FIGS. 9*c* and 9*d* shows the base 111 connected to the corner post 100 with angled braces 113 with curved ends attaching the base 111 to the angled support bar 114 which is attached to a sliding bracket 125 attached to a cross bar 121.

FIGS. 9*e*, 9*f*, 9*g* and 9*h* shows the corner components with the straight angled braces 113.

FIGS. 10*a* and 10*b* shows the cross bar section 120 with a pivotal top bar configuration at the top of the cross bar section 120. The top bar 129, in the preferred embodiment, comprises two bars that are connected by top bar pivot 127 as shown in FIG. 10*a*. The two bars do not have to be of equal length. The two bars pivot or scissor on the top bar pivot 127 and are locked into a straight configuration using a locking mechanism 128 such as a locking socket and pin 126 as shown in FIG. 10*b*

The top bar 129, as shown in FIG. 7, can be also be a solid bar which can be removable or movable. The solid bar would be connected to the brackets with a removable or fixed pin.

As shown in FIG. 10*a*, the top bar 129 acts as a lever to pull up the bottom bracket 140 on the corner post 100 making it easier to set up the pop-up canopy. The lever point is the cross bar pivots 122.

FIG. 11 shows a line of a plurality of cross bar sections 120 that run from two corner posts 100. The cross bar sections 120 are connected to each other through the top brackets 160 and bottom brackets 170 and connected to the two corner posts 100 by the lower pole bracket 140 and the higher pole bracket 150.

FIG. 12*a* shows a side line 600 being collapsed together with the cross bar section 120 turning on the cross bar pivots 122 so the cross bar 121 fold together as shown in FIG. 12*b*. FIG. 12*c* shows the sections being collapsed with top bars 129 and support cable 180. FIG. 12*d* shows a cross line 650 being collapsed.

FIG. 13 shows a side view of two frames connected together with an upright 130 being positioned between the two connected frames. FIG. 14 shows a similar configuration with a set of three uprights 130.

FIG. 15 shows a side view of the frame with one upright 130 centered between two cross bar sections 120 with a support cable 180 on the top and bottom of the cross bar sections 120.

FIGS. 16*a* and 16*b* show a frame configuration with a movable center support pole 500 that supports the middle of the side line 600 of cross bar sections 120 with three uprights 130. The support pole 500 can be detached from the line of cross bar sections when the line is being collapsed.

FIG. 17 shows the double frame configuration forming a 20 by 20 foot canopy 1 with a cover 10 on it with a support pole 500 in the center. FIGS. 18 and 19 show another embodiments with a plurality of frames connected together.

FIG. 20 shows a view of the short side of the frame.

While the preferred embodiment of the invention has been described herein, variations in the design may be made.

The various features associate with the examples described herein and shown in the accompanying drawings can be implemented in different examples and implementations without departing from the scope of the present disclosure. Therefore, although certain specific constructions and arrangements have been described and shown in the accompanying drawings, such embodiments are merely illustrative and not restrictive of the scope of the disclosure, since various other additions and modifications to, and deletions from, the described embodiments will be apparent to one of ordinary skill in the art.

What is claimed is:

1. A device comprising:

a collapsible canopy frame where the frame has a plurality of corner assemblies which comprise a foldable base, a plurality of angled support bars, a corner pole connected by side lines with a plurality of cross lines connected to the side lines that connect perpendicularly between the side lines where the side lines and cross lines have a plurality of cross bar sections where the cross bar sections have two cross bars connected by a cross bar pivot, where the cross bar sections are connected to a plurality of top brackets and bottom brackets where the top brackets and the bottom brackets connect one of the cross bar sections to another one of the cross bar sections, having the top brackets connected by a plurality of top bars and a support cable running between the bottom brackets, where the cross bar sections connect to the corner pole with a higher pole bracket and a lower pole bracket where the lower pole bracket slides up and down on the corner pole and where the plurality of angled support bars are connected to one of the cross bars with a sliding bracket that can slide along the cross bar the corresponding angled support bar is attached to.

2. A device according to claim 1 further comprising:

where each of the plurality of angled support bars has an adjustable length.

3. A device according to claim 1 further comprising:

having the top brackets and the bottom brackets connected by a truss.

4. A device according to claim 3 further comprising:

where the truss has an adjustment means.

5. A device according to claim 3 further comprising:

having the truss comprised of a turnbuckle.

6. A device according to claim 5 further comprising:

adjusting the turnbuckle to adjust the distance between the top bracket and the bottom bracket.

7. A device according to claim 1 further comprising:

having a plurality of movable uprights extend up from the frame.

8. A device according to claim 1 further comprising:

having stabilizing weights on the corner pole assemblies.

9. A device according to claim 1 further comprising:

where each of the plurality of top bars consists of two pieces connected by a stop bar pivot and where the pieces pivot on the stop bar pivot and lock into a straight line using a locking mechanism.

10. A device according to claim 9 further comprising:

where the locking mechanism has a locking button hole which locks the two pieces of the top bar together in a secure straight line.

11. A device according to claim 1 further comprising:

where each of the plurality of top bars consists of a single solid bar.

12. A device according to claim 1 further comprising:

having a plurality of diagonal support cables.

13. A device according to claim 12 further comprising:

where the diagonal support cables run diagonally from the corners to a center point of rectangles formed by the plurality of cross bar sections.

14. A device used to form a canopy frame comprising:

a plurality of cross bar sections where the cross bar sections have two cross bars connected by a cross bar pivot, where the cross bar sections are connected to a plurality of top brackets and bottom brackets where the top brackets and bottom brackets connect one of the cross bar sections to another one of the cross bar sections, having the top brackets connected by a plurality of top bars where each of the plurality of top bars consists of two pieces connected by a stop bar pivot and where the pieces pivot on the stop bar pivot and lock into a straight line using a locking mechanism where the locking mechanism has a locking button hole which locks the two pieces of the top bar together in the straight line.

15. A device according to claim 14 further comprising:

having the bottom brackets connected by a support cable.

* * * * *